US006138758A

United States Patent [19]

Shaw et al.

[11] Patent Number: 6,138,758

[45] Date of Patent: Oct. 31, 2000

[54] METHOD AND APPARATUS FOR DOWNHOLE HYDRO-CARBON SEPARATION

[75] Inventors: Christopher K. Shaw, Claremore, Okla.; Peter A. Thompson, Gloucester, United Kingdom

[73] Assignee: Baker Hughes Incorporated, Houston, Tex.

[21] Appl. No.: 09/482,177

[22] Filed: Jan. 12, 2000

Related U.S. Application Data

[62] Division of application No. 08/937,191, Sep. 25, 1997.
[60] Provisional application No. 60/027,282, Sep. 27, 1996.

[51] Int. Cl.[7] ..... E21B 33/138; E21B 43/40

[52] U.S. Cl. ..... 166/265; 166/105.5; 166/106; 166/372; 210/512.2; 210/747; 405/128

[58] Field of Search ..... 166/105.5, 106, 166/265, 313, 370, 372; 210/170, 512.2, 747, 788; 405/128

[56] References Cited

U.S. PATENT DOCUMENTS

| | | | |
|---|---|---|---|
| 1,547,194 | 7/1925 | Arbon | 166/372 X |
| 2,953,204 | 9/1960 | Doscher et al. . | |
| 3,137,344 | 6/1964 | Wiemer . | |
| 3,705,626 | 12/1972 | Glenn, Jr. et al. | 166/267 |
| 3,707,157 | 12/1972 | Tipton et al. | 137/14 |
| 3,951,457 | 4/1976 | Redford | 299/5 |
| 3,978,926 | 9/1976 | Allen | 166/267 |
| 4,120,795 | 10/1978 | Lavel, Jr. . | |
| 4,148,735 | 4/1979 | Lavel, Jr. . | |
| 4,241,787 | 12/1980 | Price | 166/105 |
| 4,296,810 | 10/1981 | Price | 166/265 |
| 4,354,553 | 10/1982 | Hensley . | |
| 4,377,208 | 3/1983 | Elliott et al. | 166/265 |
| 4,475,603 | 10/1984 | Hayatdavoudi | 175/65 |
| 4,488,607 | 12/1984 | Hayatdavoudi et al. | 175/65 |
| 4,596,516 | 6/1986 | Scott et al. | 417/58 |
| 4,688,650 | 8/1987 | Hayatdavoudi et al. | 175/324 |
| 4,711,720 | 12/1987 | Young | 210/512.2 |
| 4,721,565 | 1/1988 | Carroll | 210/251 |
| 4,738,779 | 4/1988 | Carroll et al. | 210/512.2 |
| 4,749,034 | 6/1988 | Vandevier et al. | 166/105 |
| 4,766,957 | 8/1988 | McIntyre | 166/265 |
| 4,787,452 | 11/1988 | Jennings, Jr. . | |
| 4,793,408 | 12/1988 | Miffre | 166/53 |
| 4,805,697 | 2/1989 | Fouillout et al. | 166/265 |
| 4,824,562 | 4/1989 | Carson | 210/104 |
| 4,836,935 | 6/1989 | Lilienthal | 210/788 |

(List continued on next page.)

FOREIGN PATENT DOCUMENTS

| | | |
|---|---|---|
| 0322958A2 | 7/1989 | European Pat. Off. . |
| 0532397A1 | 3/1993 | European Pat. Off. . |
| 0811749A1 | 12/1997 | European Pat. Off. . |
| 2194575 | 3/1988 | United Kingdom . |
| WO 94/13930 | 6/1994 | WIPO . |
| WO 96/30625 | 10/1996 | WIPO . |

OTHER PUBLICATIONS

B.R. Peachey and C.M. Matthews, "Downhole Oil/Water Separator Development"; *The Journal of Canadian Petroleum Technology*; vol. 33, No. 7 (Sep. 1994).

B.R. Peachey and C.M. Matthews, "Downhole Oil/Water Separator Development"; Petroleum Society of CIM, Paper No. CIM 93 (circa 1994).

(List continued on next page.)

*Primary Examiner*—George Suchfield
*Attorney, Agent, or Firm*—Thomason, Moser and Patterson, L.L.P.

[57] ABSTRACT

Methods and apparatus are provided for separation of liquids of different densities in production fluid streams from underground wells. Methods and apparatus are also provided for separation of gas, oil and water in production fluids, transportation of the separated fluids to the surface, as well as reinjection of separated water from the production fluids into other formations. Other aspects include new separation arrangements which include gas or liquid driven motors, designs for multi-stage hydrocyclone separators and use of beam or rod pumps.

25 Claims, 17 Drawing Sheets

U.S. PATENT DOCUMENTS

| | | | |
|---|---|---|---|
| 4,900,433 | 2/1990 | Dean et al. | 210/170 |
| 4,913,630 | 4/1990 | Cotherman et al. | 417/313 |
| 5,031,697 | 7/1991 | Wellington | 166/372 X |
| 5,154,588 | 10/1992 | Freet et al. | 417/423.3 |
| 5,159,977 | 11/1992 | Zabaras | 166/105 |
| 5,173,022 | 12/1992 | Sango | 415/169.1 |
| 5,296,153 | 3/1994 | Peachey | 210/787 |
| 5,320,500 | 6/1994 | Cholet | 417/375 |
| 5,335,732 | 8/1994 | McIntyre | 166/313 |
| 5,377,756 | 1/1995 | Northrop et al. | 166/267 |
| 5,425,416 | 6/1995 | Hammeke et al. | 166/105.5 |
| 5,456,837 | 10/1995 | Peachey | 210/512.2 |
| 5,497,832 | 3/1996 | Stuebinger et al. | 166/369 |
| 5,503,226 | 4/1996 | Wadleigh | 166/252.1 |
| 5,570,744 | 11/1996 | Weingarten et al. | 166/357 |
| 5,579,838 | 12/1996 | Michael | 166/106 |
| 5,603,825 | 2/1997 | Costinel | 210/109 |
| 5,711,374 | 1/1998 | Kjos | 166/265 |
| 5,730,871 | 3/1998 | Kennedy et al. | 210/512.2 |
| 5,762,149 | 6/1998 | Donovan et al. | 166/265 |
| 5,830,368 | 11/1998 | Peachey | 210/747 |
| 5,857,519 | 1/1999 | Bowlin et al. | 166/105.6 |

OTHER PUBLICATIONS

Pete Schrenkel, Robert Cox, Steve Kennedy and Bill Bowers; "Joint Industry Development of the Downhole Water Separation System".

"Downhole Oil/Water Separation Technology Now Proven", Centre for Engineering Research Inc., Press Release (Apr. 1, 1995).

"Downhole Oil/Water Separator Development Project", Paper C–FER.

B.E. Bowers, D.D. Lloyd, C. Matthews and P. Schrenkel; "Downhole Application of Liquid–Liquid Hydrocyclones".

T. Kjos, READ Group A.S., J.F. Michelet, READ Process Engineering A.S., S. Sangesland, "Subsea and Downhole Separation Systems—The Latest Advances", Paper, *Norwegian Institute of Technology*, Paper No. XP000671682.

METHOD AND APPARATUS FOR DOWNHOLE HYDRO-CARBON SEPARATION

This application is a divisional that claims priority to U.S. Ser. No. 08/937,191, filed Sep. 25, 1997, which claims benefit to U.S. Provisional Application No. 60/027,282, filed Sep. 27, 1996, which are both incorporated herein by reference.

BACKGROUND OF THE INVENTION

1. Field of the Invention

In some aspects, the present invention relates to apparatus and methods for separation of liquids of different densities in production fluid streams from underground wells. More specifically, these aspects of the invention relate to the separation of water and oil in production fluids. The present invention also relates to apparatus and methods for pumping and transport of the separated liquids to the surface or to other portions of a wellbore. In other aspects, the invention also relates to methods and apparatus for reinjection of separated water from production fluid into formations to stimulate flow of hydrocarbons. Other aspects of the disclosed invention include new separation arrangements which incorporate gas or liquid driven motors, designs for multi-stage hydrocyclone separators, and use of beam or rod pumps.

2. Description of Related Art

Recently, the value has been recognized of employing a downhole separator apparatus such as a hydrocyclone-based separator in producing oil wells. A hydrocyclone-based separator is capable of substantially separating a mix of two liquids of different densities into two streams of those constituent liquids. The separator apparatus is designed to receive a production stream of oil which contains a significant amount of water, the production stream being obtained from production perforations leading to a producing zone within the surrounding formation. The separator then receives the production stream and substantially separates the oil from the water to produce a clean water stream which has a low concentration of oil and a concentrated oil stream from which the water has been substantially removed. Typically, the clean water stream is then directed toward injection perforations in another potential production zone or another area of the current production zone. This area is referred to as the disposal or injection zone. A suitable separator assembly for such applications, as well as the applications described herein,, is the VORTOIL® Downhole Oil Water Separator assembly available commercially from Baker-Hughes Process Systems, 6650 Roxburgh, Suite 180, Houston, Tex. 77041. Aspects of the construction and operation of some separator assemblies are also described in U.S. Pat. Nos. 5,296,153, "Method and Apparatus for Reducing the Amount of Formation Water in Oil Recovered from an Oil Well," and 5,456,837, "Multiple Cyclone Apparatus and Downhole Cyclone Oil/Water Separation," both issued to Peachey; International PCT Published Patent Application WO 94/13930, entitled "Method for Cyclone Separation of Oil and Water and Means for Separating of Oil and Water," as well as other patents and publications.

The separator assembly is normally coupled with a fluid pump such as a multi-stage centrifugal pump or a progressive cavity pump (PCP) as well as a motor which drives the pump to assist in bringing the concentrated oil stream to the surface. Collectively, these arrangements are referred to as motor-pump-separator assemblies.

If the clean water stream is directed to injection perforations located below or downhole from the production perforations, his is known as a downhole arrangement. Conversely, if the injection perforations are located above or uphole from the production perforations, this is known as an uphole arrangement, Typically, the drilling arrangements which use motor, pump and separator assemblies of this type have well casing diameters measuring 5½ inches, 7 inches or 9⅝ inches. However, these are merely standard conventional measurements and are not intended to limit this discussion or application of the present invention. Packers made for systems of this size are useful for packing off tubing which has a relatively small outer diameter as compared to the inner diameter of the production casing. In a 5½ inch casing, for example, the packer would be capable of packing off a tubing or other member which is roughly 3 inches in diameter or smaller. However, it would be difficult if not impossible without the use of specialized equipment to pack off tubular members having a diameter larger than 3 inches within such a casing.

Other problems exist with arrangements which require more than one pump to assist in transmitting the concentrated oil stream toward the surface of the well. Certain arrangements require dual pumps to assist transmission of the concentrated oil stream toward the surface of the well. In current practice using a dual pump arrangement, a motor is centrally located and attached by means of seal above and below to two pumps. The first pump is a high volume, low head pump which moves the concentrated oil stream upward to the second pump which is a low volume, high head pump and which functions primarily to assist the concentrated oil stream toward the surface. The prior art method uses a single motor to drive both pumps. The prior art method may not be suitable in certain situations such as where the secondary pump must be placed too deeply to be effective in assisting the oil to the surface.

It is an object of the present invention to provide for motor, pump and separator assemblies which are capable of improved operation over prior art systems.

SUMMARY OF THE INVENTION

The present invention has numerous aspects which are described by way of several exemplary embodiments. In one aspect of the invention, a downhole arrangement is described wherein a motor-pump-separator assembly is placed within the wellbore to effectively exploit the production interval provided between the location of the production perforations and the intake of the pump. A packer is set between the well casing and the outer surface of the motor, pump and separator assembly rather than setting the packer between the well casing and tubing located below the assembly. Preferably, the packer is set against a reduced diameter intermediate sub which interconnects the pump to the separator.

In a second aspect of the present invention, there is described an improved relay pump arrangement by which the concentrated oil stream is assisted in reaching the well surface. In the arrangement described, the second pump may be located a significant distance uphole from the motor, pump and separator assembly, thus acting as a relay pump to assist movement of the oil.

In a third aspect of the present invention, a motor-pump-separator assembly is provided which incorporates a rotary gas separator and reinjection arrangement. A rotary gas separator is incorporated into the pump proximate the pump inlet so that the rotary gas separator removes gas from the production fluid as it enters the pump. The removed gas is then injected into the stream of concentrated oil which is being transported to the surface. The concentrated oil conduit contains an eductor or restriction in the interior diameter of the tube and a jet nozzle. The jet nozzle accelerates the concentrated oil within the production tubing. These devices cause a local pressure reduction which permits effective introduction of removed gases into the concentrated oil stream to assist in lifting the concentrated oil toward the surface of the well.

In a further aspect of the invention an embodiment is described wherein a hydraulic motor is located within a dry portion of the annulus and used to power a pump and separator apparatus in a non-dry portion of the annulus. Further, motor exhaust from the hydraulic motor is transmitted into the concentrated oil transport conduit to assist in lifting the concentrated oil toward the surface of the well.

In yet another aspect of the invention, a motor, pump and separator apparatus contains a separator which is adapted to release the clean water stream laterally into the wellbore annulus for entry into injection perforations. The power cable which supplies power to the motor is partially disposed radially inside of the production string.

In another aspect of the invention, an uphole arrangement is described in which a relay or booster pump assembly is utilized for movement of concentrated oil toward the surface of the well.

Alternate embodiments of uphole arrangements are also described which illustrate various aspects of the invention. In one, all components of the motor, pump and separator assembly are located above the highest packer in the disposal zone making it possible to remove the components from the well without having to first unset a packer. In a further uphole arrangement, production is obtained from downhole production perforations and, as it travels to the surface, the production fluid is passed through an isolated uphole disposal zone via a conduit. Other aspects of the present invention will also be apparent by reference to the embodiments described below.

DETAILED DESCRIPTION OF THE PREFERRED EMBODIMENTS

Figure 1:
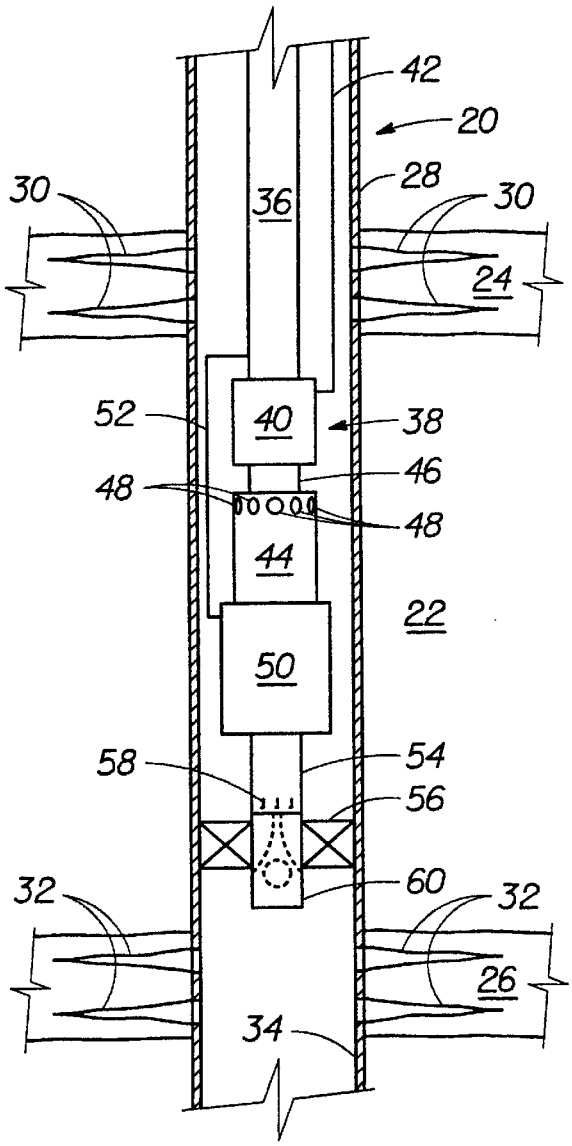
FIG. 1 (PRIOR ART)
FIG. 1 is a partial cross-section of a conventional prior art motor-pump-separator assembly.

Numerous features and advantages are associated with the several specific, exemplary embodiments of the invention which will be described herein. These include the following:

Improved Pump Effectiveness

Through methods and apparatus described herein, a motor-pump-separator assembly is packed off along its length rather than packing off the out flow tubing located below the assembly. It is preferred that the packer be packed off against an intermediate sub located between the pump and the separator assembly. This arrangement permits exploitation of much shorter production intervals than was previously possible using prior art techniques. A typical production interval associated with a single production zone is defined by production perforations located usually at the upper portion of the production zone and injection perforations located proximate the lower end of the production zone. When production fluid is drawn from the upper portion of the zone and water is reinjected into the lower portion of the zone, the zone itself includes a water/oil interface within. In downhole arrangements, the production perforations must be located above the oil/water interface while the injection perforations must be located below this interface. If the production zone is relatively thin, the vertical distance between the production perforations and the injection perforations is limited. If this distance is very small, for example, less than 90 feet, using prior art techniques it may not be possible to efficiently draw production fluid from the production perforations while at the same time reinjecting the water into injection perforations in the same zone. Therefore, the ability to pack off the motor-pump-separator assembly along the length of the assembly itself has significant advantages.

Arrangements are also described wherein a beam or rod pump is used to both pump production fluid into a separator assembly and also draw concentrated oil from the separator to pump toward the surface for recovery. This arrangement enhances the efficiency of the system. A vibration dampener may be placed between the pump and the intake of the separator to dampen peaks and valleys in the production fluid flow rate.

Relay Pump Arrangements

A number of embodiments are described which incorporate relay pumps positioned at a location uphole of the separator assembly and primary pump. Embodiments are described in which the relay pump comprises a hydraulic pump as well as a surface shaft driven pump such as a progressive cavity pump or rod pump. Use of a relay pump assists lifting of the concentrated oil stream to the surface of the well where the residual pressure in the concentrated oil stream is low. In some embodiments, a shroud surrounds portions of the motor driving the pump to ensure sufficient velocity of fluids passing the motor for the motor to be cooled.

Gas Handling

Another aspect which will be described in conjunction with various embodiments of the resent invention is removal of free gases from production fluid using a rotary gas separator so that those gases are typically returned to the surface for collection or release by venting. The principal importance of a removal system such as a rotary gas separator is for the removal of free gas from production fluid prior to entrance of the production fluid into the pump.

Additional Oil Lift Techniques

Other arrangements and techniques for assisting movement of concentrated oil to the surface for collection are described in conjunction with the present invention. First, gas lift valve arrangements are described in which gas lift valves are incorporated into the production tubing within the well. Pressurized gas within the wellbore is transmitted by the gas lift valves into the production tubing. Another arrangement is described in which free gas removed from production fluid by a rotary gas separator (thereby functioning as a gas/liquid separator) is reinjected into the dry oil stream to help lifting of the dry oil to the surface of the well. This arrangement is recommended if it is not possible or desirable to return this gas to the surface through the annulus and/or vent it at the surface, or, if the gas is needed to lighten the oil by gas lift. Additionally, techniques and apparatus are described for using the exhaust of a hydraulic motor powered by pumped in fluids to assist lifting of dry gas toward the surface of the well.

Solids Handling

If sand and other solids are not removed from the production fluid before it undergoes separation, those solids typically end up in the clean water stream and are deposited in the disposal zones. This is undesirable as build up of solids tends to interfere with clean water injection in the disposal zone and can reduce the ultimate recovery of hydrocarbons from that zone. Several methods and apparatus are used which remove solids, such as sand, from production fluid prior to its separation. Typically, a solids separator such as a screen, a static guided vane or a rotary device powered by a pump motor is positioned so as to remove the solids before they enter the pump. These devices are often located proximate the intake ports of the pump. The removed solids are deposited on top of the lower packer which is located above the disposal zone. Unfortunately, this may make it difficult or impossible to later remove the lower packer. Methods and apparatus are described herein in which sand or other solids are removed from the production fluid by directing the fluid through a sand handling pump, such as the Centrilift Sand Handling Pump, prior to the production fluid entering a separator. This type of pump may be used in place of the conventional fluid handling pump. The advantage of using this technique for removal of solids is that the removed solids are deposited neither in the disposal zone nor on top of a packer. Rather, the solids are transported toward the surface for collection.

Hydrocyclone Separators

Embodiments of hydrocyclone separators are described in which multiple hydrocyclones are arranged for the effective separation of oil from water. In some embodiments, the concentrated oil stream removed from the first hydrocyclone stage is recycled into the production fluid which will enter the second hydrocyclone stage or subsequent stage resulting in a greater effective separation of oil from water. Specific embodiments for these staged hydrocyclone systems are described in which available space within the housing of the separator is maximized for process use. Other embodiments of single and multiple hydrocyclone systems are described in which space available to conduct the separation process is allocated by seals established between the wellbore casing and either the separator casing or an individual hydrocyclone within the separator.

Power Supplies

In most described embodiments, electrical power is supplied to the downhole motor or motors using an electrical power cable which extends downward from the surface of the well and connects to the motor. However, arrangements are also described wherein a power source for a motor is disposed within the wellbore. The downhole power source preferably comprises a battery or fuel cell, but may comprise other power sources as well.

The many features and aspects of the present invention are described with respect to FIGS. 1 through 31. Unless otherwise specifically described in the specification, components described are assembled or affixed using conventional connection techniques including threaded connections, collars and such which are well known to those of skill in the art. The use of elastomeric O-rings and other standard techniques to create closure against fluid transmission is also not described herein in any detail as such conventional techniques are well known in the art and those of skill in the art will readily recognize that they may be used where appropriate. Terms used in the description such as "up," "above," "upward" and so forth are intended to refer to positions located closer to the wellbore opening as measured along the wellbore. Conversely, terms such as "down," "below," "downward," and such are intended to refer to positions furthers away from the wellbore opening as measured along the wellbore.

FIG. 1 depicts an exemplary prior art arrangement for a motor-pump-separator assembly within a wellbore which uses a single pump. A well 20 is disposed within the earth 22 such that it passes through two formations or formation zones 24 and 26. The well 20 includes a casing 28. Zone 24 is an oil producing zone from which it is desired to remove production fluid through production perforations 30 in the well casing 28. Zone 26 is referred to as a disposal zone into which it is desired to inject relatively clean water for the stimulation of hydrocarbons for later production. It is noted that the zones 24 and 26 may be two separate hydrocarbon zones or they may be two locations within the same hydrocarbon zone. In the latter instance, water is typically injected into one of the locations with the purpose of urging it toward the other location.

Injection perforations 32 are disposed through the wellbore casing 28 and into the disposal zone 26. The wellbore casing 28 encloses the wellbore 34 into which is suspended a string of production tubing 36 which extends downwardly from the surface of the well. As most of these features are common to all of the embodiments to be described herein, like numbers will be used for them throughout the description.

At the lower end of the production tubing 36 in FIG. 1 is affixed a conventional motor-pump-separator assembly 38. The motor-pump-separator assembly 38 includes a motor 40 which is an electrical submersible motor of a type known in the art for operation of downhole pumps. Power cable 42 extends downward through the wellbore 34 from the surface of the well to provide power to the motor 40. The motor 40 is affixed to a pump 44 so as to drive the pump 44. An elastomer barrier seal 46 may be incorporated with the motor 40 to help prevent well fluid from entering the motor 40 and equalize internal motor pressure with well annulus pressure. The pump 44 is typically a high volume, low head pump of a type known in the art and includes laterally spaced intake ports 48 into which a stream of production fluid drawn from production perforations 30 enters. It is noted that the motor 40 is positioned between the production perforations 30 and the intake ports 48 so the flow of production fluid from the production perforations 30 past the motor 40 toward the intake ports 48 will cool the motor 40 in operation.

A separator assembly 50 is affixed to the lower end of the pump 44 and operationally associated so that production fluid entering the intake ports 48 is supplied by the pump 44 to the separator 50 for separation. By way of brief description of operation, a typical separator assembly 50 is made up of a housing which encloses a central chamber having at least one hydrocyclone within. Mixed production fluid within the chamber of the separator 50 will enter the hydrocyclone which separates the mixed oil and water in the production fluid. The clean water is directed into an underflow conduit through which it exits the separator assembly 50, and the concentrated oil is directed into an overflow conduit through which it separately exits the separator 50.

After separation, the concentrated oil stream exits the separator 50 and enters a concentrated oil conduit 52 which extends from the separator 50 upward to production tubing 36 for transport toward the surface. At the lower end of the separator 50 is affixed outflow tubing 54 into which the clean water stream is directed. A packer 56 is set between the wellbore 34 and the outflow tubing 54. Typically, a quick disconnect 58 is provided in the outflow tubing so that components above the packer 56 may be removed from the wellbore 34 without having to unset the packer 56. The outflow tubing 54 includes a check valve 60 which is shown schematically. The check valve 60 will close against upward flow to prevent movement of fluids below the packer from migrating upwardly in the wellbore 34.

Figure 2:
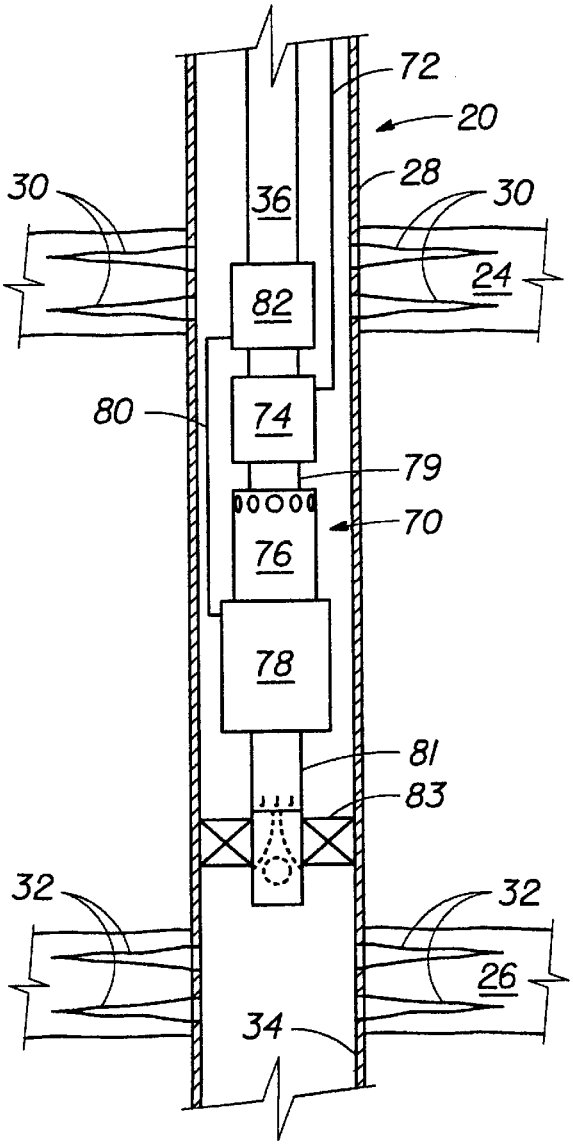
FIG. 2 (PRIOR ART)
FIG. 2 is a partial cross-section of a prior art motor-pump-separator assembly having a secondary pump to assist in transporting the produced concentrated oil stream towards the surface of the well.

Referring now to FIG. 2, a typical prior art arrangement is depicted which employs a dual pump arrangement for assisting oil of the concentrated oil stream toward the surface of the well. This type of arrangement is more typically used where the production zone is particularly deep so that there is a significant head pressure from fluid in wellbore 34 which must be overcome to transmit the concentrated oil to the surface, and where the disposal zone has high infectivity and/or low pressure. In this arrangement, a motor-pump-separator assembly 70 is positioned within the wellbore 34 whose construction and operation is substantially identical to that of the motor-pump-separator assembly 38 described with respect to FIG. 1. Power cable 72 supplies power to the motor 74 of the assembly 70 from the surface as previously described, and the motor 74 is affixed to a pump 76 and separator apparatus 78 using a seal as previously described. A concentrated oil conduit 80 extends outward from the separator apparatus 78 and conducts the concentrated oil stream to a second pump 82. Unlike the pump 76, the second pump 82 is a low volume, high head pump which pumps the concentrated oil stream uphole within production tubing 36 toward the surface of the well 20. Outflow tubing 81 is affixed to the lower end of the separator 78. Tubing 81 is packed off by packer 83 and includes a quick disconnect and a check valve arrangement.

Figure 3:
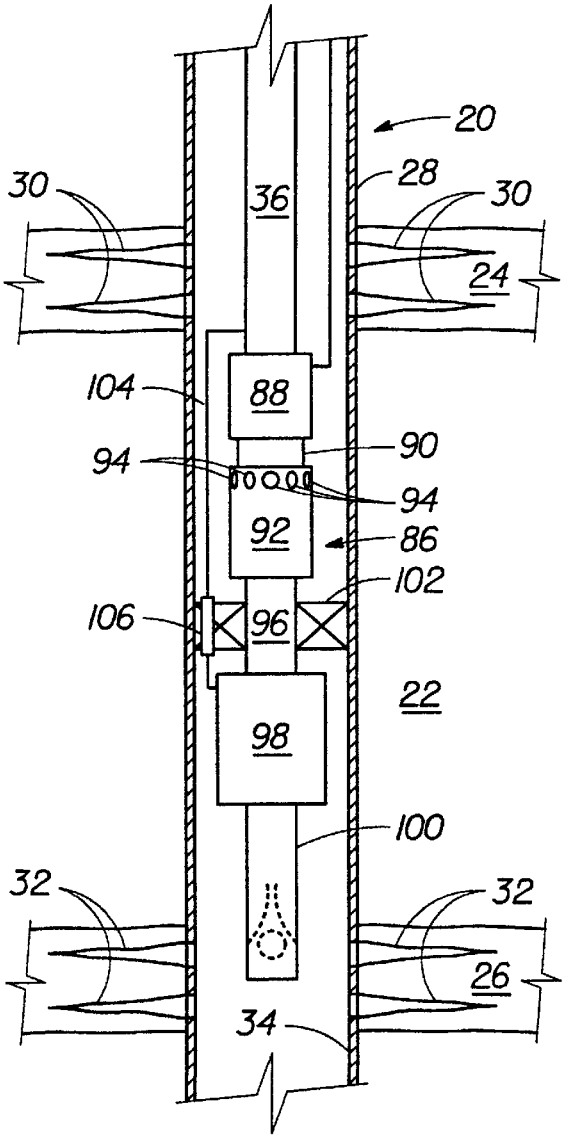
FIG. 3 is a partial cross-section view of a first embodiment of a motor pump separator assembly arranged in a downhole fashion.

Referring now to FIG. 3, a first novel embodiment is depicted of an inventive arrangement for a motor-pump-separator assembly 86 within wellbore 34. In this embodiment, the motor-pump-separator assembly 86 features a motor 88 which is affixed to pump 92 having circumferentially-spaced lateral intake ports 94. An elastomer barrier seal 90 may also be incorporated. Unlike the motor-pump-separator assembly 38 described with respect to FIG. 1, the motor-pump-separator assembly 86 includes a reduced diameter intermediate sub 96 which interconnects the lower end of the pump 92 to the separator 98. The intermediate sub 96 preferably has a cross-sectional diameter approximately equal to that of the production tubing 36 and/or the outflow tubing 100. The sub 96 has a reduced diameter with respect to the pump 92 and separator 98 to provide room for a packer 102 to be set to seal between the sub 96 and the wellbore 34. The concentrated oil conduit 104 passes through the packer 102. Preferably, this is accomplished with the aid of a packer penetrator 106 which permits a conduit to pass through a packer while maintaining the fluid seal provided by the packer 102. A useful packer penetrator 106 is the Packer Penetrator System available from Quick Connectors, Inc. of 5226 Brittmore, Houston, Tex. There is no packer set between the outflow tubing 100 and the wellbore 34. Because the packer 102 is set to seal the wellbore above the separator 98, it is positioned higher or further uphole in the wellbore than the packer 56 of the prior art arrangement of FIG. 1 resulting in a shorter allowable production interval. Production interval, as used herein, refers generally to the vertical distance along the wellbore between the production perforations and the point within the wellbore at which it is desired to inject water. In most instances, a motor-pump-separator assembly will be 90 feet or greater in length. However, if the thickness of the production zone is, for example, only 50 feet, water cannot be efficiently disposed into the lower injection perforations without raising the motor above the production perforations.

Figure 4:
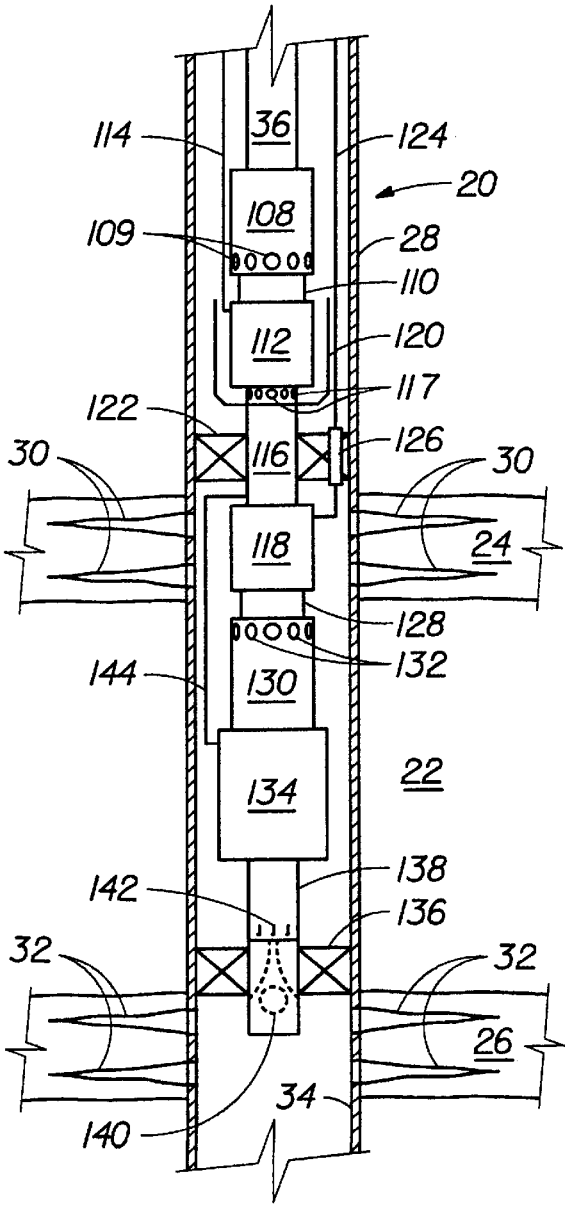
FIG. 4 is a partial cross-section of a second, downhole embodiment of the present invention in which a relay pump is incorporated into the production string.

FIG. 4 is a schematic representation of an embodiment of a second aspect of the present invention in which a relay pump arrangement is used. The arrangement is described from top to bottom or uphole to downhole. At the lower end of production tubing 36 is affixed a low volume, high head relay pump 108 which is similar in construction and operation to the second pump 82 described and shown with respect to FIG. 2. The pump 108 is intended to function as a relay pump which will assist transmission of the concentrated oil stream to the surface of the well. The pump 108 includes lateral fluid intake ports 109 and is affixed with an elastomer seal 110 to a first motor 112. A power cable 114 supplies power to the first motor 112. A reduced-diameter section of production tubing 116 extends from the lower end of the first motor 112 to a second motor 118 to adjoin the two motors. The two motors 112 and 118 operate independently of one another. The production tubing 116, although shown to be relatively short in length in the schematic of FIG. 4, may be of any desired length. It is contemplated that the length of tubing 116 may be between 10 and 10,000 feet.

A motor shroud 120 is shown surrounding at least a portion of the motor 112 and the connecting portion of the production tubing 116. It should be pointed out a shroud is only required where the wellbore 34 is of relatively large size, such as 7" or 9⅝", and where the motor 112 is of a smaller relative diameter, such as 6", which would result in a large gap between the motor 112 and casing 34 so that there is a reduced velocity of the production fluid flowing past the motor 112. For smaller casing sizes, such as 5" casing, there is a suitably small gap between the motor and borehole casing 34 to ensure that the production fluid flows past the motor 112 at a sufficiently high velocity for the motor 112 to be cooled. When used, the shroud 120 is preferably sized so that liquids passing by the motor 112 have a surface velocity greater than 1.0 ft/sec. Presently, a preferred distance between the motor 112 and either the casing 34 or shroud 120 is approximately ½ inch. The lower end of the shroud 120 seals against the production tubing 116 so as to enclose the lower end of the motor 112. The connecting portion of the production tubing 116 contains perforations 117 which are located above, or uphole of the shroud's seal so that fluids exiting from the production tubing 116 through the perforations 117 will be disposed within the enclosure of the shroud 120. The upper end of the shroud 120 is not sealed against the motor 112, seal 110 or pump 108, thereby permitting fluid entering the shroud 120 through the perforations 117 to flow upward toward the fluid intake ports 109. The motor shroud 120 functions primarily to ensure cooling of the motor 112, but also to direct fluids exiting the perforations 117 toward the intake ports 109 of the relay pump 108. Therefore, the motor shroud 120 may extend upward to surround the seal 110 and even the intake ports 109 of the relay pump 108.

At a point below the shroud 120, a packer 122 seals off the tubing 116 from the wellbore 34. A power cable 124 which extends from the surface of the well supplies power to the second motor 118. A packer penetrator 126, such as that described previously, is used to pass the power cable 124 through the packer 122.

The lower end of the second motor 118 is affixed using an elastomer seal 128 to a primary pump 130 having lateral fluid intake ports 132. The primary pump 130 is operationally interconnected with a separator assembly 134 of a type described previously. A packer 136 seals off outflow tubing 138. The outflow tubing 138 is provided with a close-off check valve 140 and a quick disconnect 142. Concentrated oil conduit 144 extends between the separator 134 to production tubing 116.

In operation, the relay pump arrangement described with respect to FIG. 4 permits effective pumping of a separated concentrated oil stream toward the surface of a well. Production fluid entering the wellbore 34 from production perforations 30 is drawn into the primary pump 130 through lateral intake ports 132. The pump 130 then pumps the production fluid through the separator 134 where it is separated into a clean water stream and a concentrated oil stream. The clean water stream is then directed through outflow tubing 138 toward injection perforations 32. The concentrated oil stream is then directed from the separator 134 through the concentrated oil conduit 144 and into the production tubing section 116. Within the tubing 116, the concentrated oil will proceed toward the well surface under impetus provided by the primary pump 130. Concentrated oil will then exit the tubing 116 through perforations 117 and be directed within the shroud 120 toward the intake ports 109 of the relay pump 108 which will pump the concentrated oil toward the surface of the well through production tubing 36.

Figure 5:
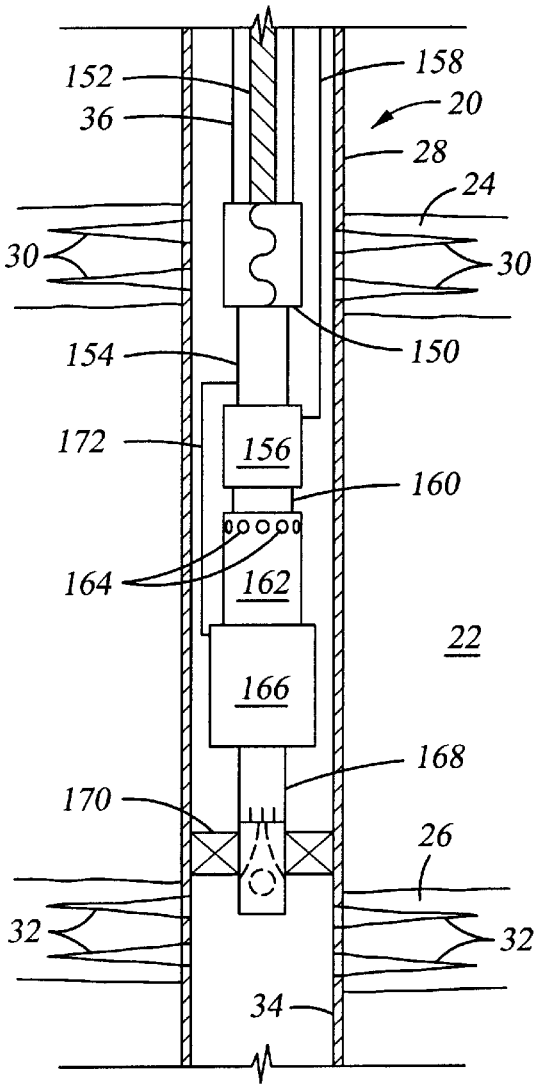
FIG. 5 is also a partial cross-section depicting an alternative embodiment of the assembly shown in FIG. 4 in which a surface driven pump is employed as the relay pump.

Referring now to FIG. 5, an alternative embodiment is described for a relay pump arrangement which incorporates a pump driven by shaft or rod extending from the surface of the well 20 to the relay pump. Preferably this pump is a progressive cavity pump, or PCP pump. However, it might also be a beam or rod pump which is driven by a reciprocating rod. Describing the components once more from top to bottom, in one embodiment the production tubing 36 is affixed to a PCP pump 150 such as a Moyno® Down-Hole Pump available from Moyno Oilfield Products, (a division of Robbins & Myers, Inc.), of 363 N. Sam Houston Parkway East, Suite 250, Houston, Tex. As is well known in the art, a PCP pump includes an external stator (not shown) and an internal rotor (not shown) which is rotated with respect to the stator to drive fluid upward within the production tubing 36. Rotation of the rotor of the pump 150 is accomplished by an affixed shaft 152 which extends downward within the tubing 36 from the surface. Rotation of the shaft 152 rotates the rotor thus pumping the fluid. The lower end of the rod-driven pump 150 is affixed to a section of production tubing 154 which, like tubing 116 described with respect to FIG. 4, may be of any desired length. The production tubing 154 extends between the pump 150 and a motor 156 below. Power is supplied to the motor 156 by a power cable 158 which extends downward from the surface of the well. Elastomer seal 160 interconnects the motor 156 to pump 162 which is provided with lateral fluid ports 164. The pump 162 functions as a primary pump and is operationally interconnected to separator 166 to provide production fluid from production perforations 30 to the separator 166. In a manner described previously, the lower end of the separator 166 is provided with outflow tubing 168 having a check valve and a quick disconnect arrangement. The outflow tubing 168 is packed off against the wellbore 34 by packer 170. Concentrated oil conduit 172 interconnects the separator 166 with production tubing 154.

Operation of this assembly is similar to that previously described for the embodiment described with respect to FIG. 4. Specifically, production fluid entering the wellbore 34 from production perforations 30 is drawn by the pump 162 into intake ports 164 and pumped through the separator 166 to be separated into a concentrated oil stream and a clean water stream. The clean water stream is directed through the outflow tubing 168 toward injection perforations 32. Meanwhile, the concentrated oil stream is transmitted via concentrated oil conduit 172 from the separator 166 to production tubing 154. The concentrated oil stream travels uphole within production tubing 154 under the impetus provided by the primary pump 162. The pump 150 serves as a relay pump, or booster pump, to assist the concentrated oil in reaching the surface of the well.

The depth or location at which a relay pump will be placed within a wellbore is largely dictated by wellbore conditions. The location is related to the amounts of residual pressure in the concentrated oil stream from the separator which is itself a function of disposal zone injectivity and pressure. Based on this information, the desired depth or location for placement can be calculated by those of skill in the art.

Figure 6:
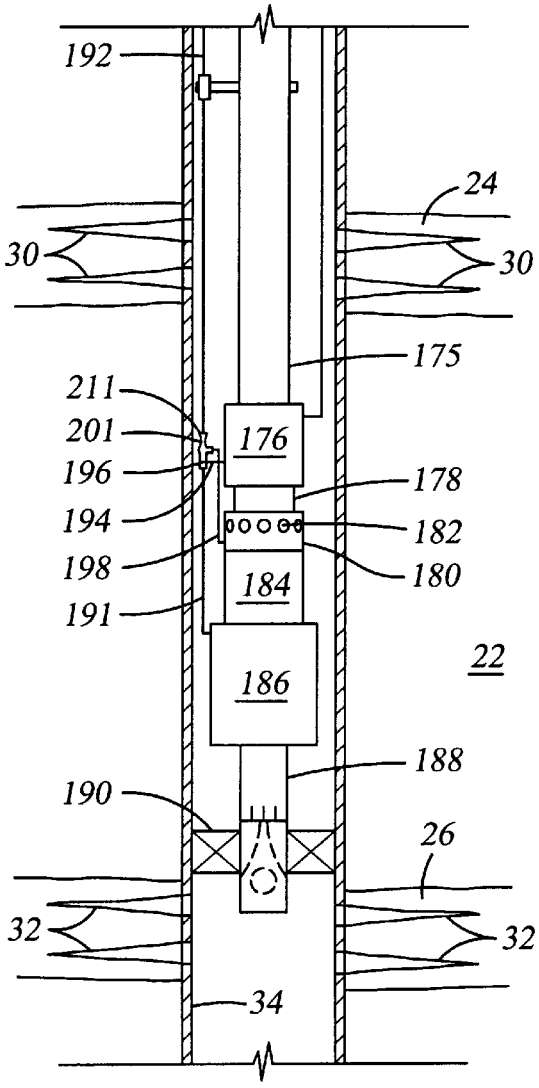
FIG. 6 is a partial cross-section which depicts a motor-pump-separator assembly of the present invention wherein rejection of removed gas by a rotary gas separator assembly is incorporated.

FIG. 6 depicts a further embodiment of an improved motor-pump-separator assembly which uses only a single motor and pump. However, in this arrangement, the concentrated oil stream is assisted toward the surface of the well via an incorporated rotary gas separator (RGS) device and associated apparatus for injecting into the concentrated oil stream gas separated from the production fluid by the RGS device. Extending downward within well 20 in FIG. 6 is a flow tubing 175 which is adapted to transmit fluid pumped downward into the tubing 175 from the surface of the well 20. The flow tubing 175 is affixed to and operationally interconnected with motor 176. Motor 176 may be a gas-powered motor operated by gas, such as methane, pumped downwardly within tubing 175. The motor 176 may be a positive displacement motor or a turbine motor. The motor 176 is affixed to an RGS device 180. A diaphragm seal 178 may be incorporated. A rotary gas separator is a device known in the art for the removal of free gases from production fluid. The RGS device 180 typically includes an interior separator chamber which is rotated by the motor 176 to accelerate fluid within a fluid stream toward an outer shell where vent ports direct freed gas laterally away from the fluid stream. A suitable rotary gas separator is the Centrilift rotary gas separator available from Centrilift. The upper portion of the RGS device includes lateral fluid intake ports 182.

The RGS device 180 is affixed at its lower end to a pump 184 which may be a centrifugal pump or a PCP pump. The pump 184 is also driven by the motor 176. The pump 184 is affixed at its lower end to an oil/water separator 186 from which extends outflow tubing 188. As described previously, the outflow tubing 188 includes a check valve and quick disconnect and is packed off against the wellbore 34 by packer 190.

A concentrated oil conduit 191 extends upwardly from the separator 186 within the wellbore 34 toward the surface of the well 20. A mechanical support or cross-over 194 can be used to connect the conduit 192 to the tubing 175 for support at intervals along the wellbore 34.

Figure 21:
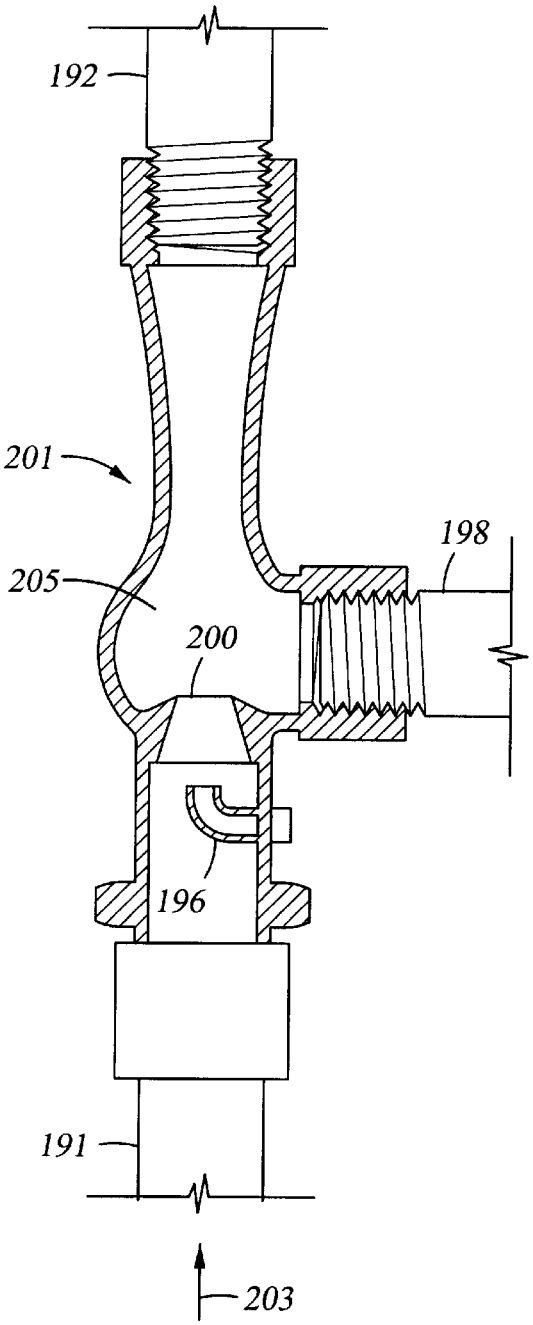
FIG. 21 is a cross-sectional detail of an exemplary tubing member having a fluid flow eductor and a hydraulic injector.

Motor exhaust tubing 194 laterally exits the motor 176, penetrating the wall of concentrated oil conduit 192 and then terminating in an upturned nozzle 196 within an eductor 201 (see FIG. 21). Exhaust gases from the motor 176 are transmitted along the tubing 194 to the nozzle 196. The arrangement of the motor exhaust tubing 194 and nozzle 196 causes concentrated oil within the conduit 192 which is proximate the nozzle 196 to become agitated. Also, a gas conduit 198 extends from the RGS device 180 to a chamber 205 in eductor 201 which may be proximate and slightly above the nozzle 196 of the motor exhaust tubing 194. The gas conduit 198 is adapted to inject free gas (which the RGS device 180 has removed from the production fluid) into the concentrated oil in the eductor 201. The eductor includes a nozzle or throat eductor restriction 200 preferably located within the concentrated oil conduit 192 at a location proximate to, but slightly above, the upturned nozzle 196.

The restriction 200 functions to speed the flow of concentrated oil upward within the eductor 201, thereby causing a pressure drop in the concentrated oil stream. As a result, the eductor 201 functions to enhance the flow of the free gas and to make the concentrated oil stream more receptive to dissolving the free gas being injected from the gas conduit 198.

An exemplary tubing member is shown in FIG. 21 with respect to which the structure and function of the eductor 201 and nozzle 196 is better understood As shown there, fluid traveling within tubing 191 in the direction of arrow 203 passes nozzle 196 and encounters eductor restriction 200. As the restriction 200 is passed, the fluid enters chamber 205 having been accelerated by the restriction and, as a consequence, undergoing a local pressure drop within the chamber 205 near the restriction 200. During the time the fluid is present in chamber 205 and its pressure is lowered, gas entering chamber 205 through conduit 198 under pressure from the RGS 180 will be at higher pressure than the fluid in chamber 205, inducing the gas to flow into chamber 205 and mix with the fluid passing through the eductor. The nozzle 196 injects gases directly into the stream of oil in tubing 192, injecting it, under pressure in the same direction as that liquid.

It is noted that gases may be introduced using the nozzle 196 without use of an eductor 201 and similarly, gas may be injected from the RGS device in the absence of any other gas injection.

In operation, production fluid from the production perforations 30 enters the RGS device 180 through the intake ports 182. The RGS device 180 then removes free gas from the production fluid and directs the production fluid into the pump 184. In turn, the pump 184 pumps the production fluid through the separator 186 for separation into a concentrated oil stream and a clean water stream. The clean water stream is directed though the outflow tubing 188 toward injection perforations 32. Meanwhile, the concentrated oil stream is directed into conduit 191. As the concentrated oil travels upwardly within the conduit 191 under the impetus provided by the pump 184, it passes nozzle 196 and reaches eductor 201. Because the free gas is significantly lighter than the concentrated oil, its presence assists rising of the concentrated oil uphole via tubing 192.

Figure 7:
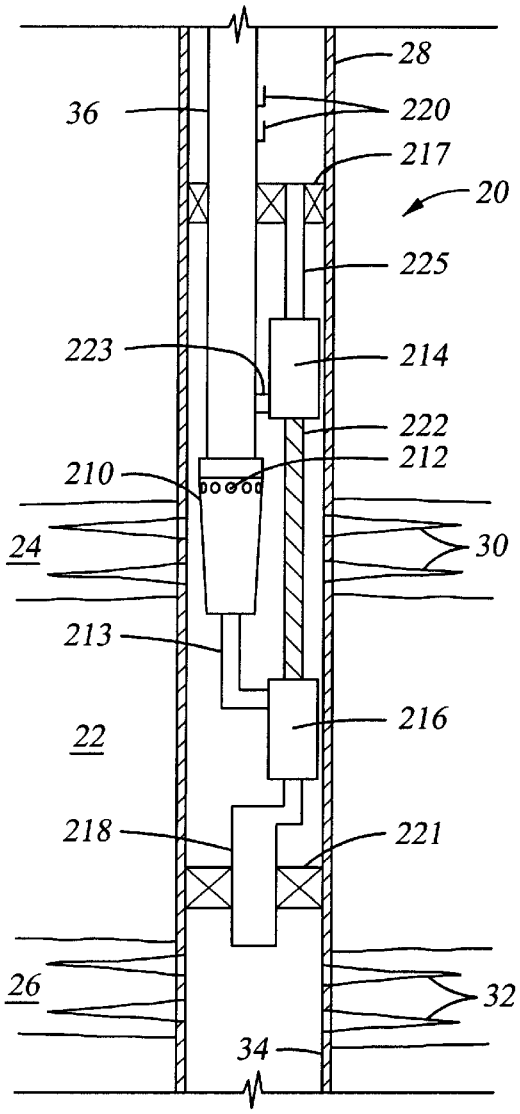
FIG. 7 is a partial cross-section which depicts a motor-pump-separator assembly in which the production stream enters the separator under reservoir production pressure.

FIG. 7 depicts an arrangement which is a variation upon the arrangement described with respect to FIG. 6. According to FIG. 7, production tubing 36 is affixed at its lower end to a separator 210 which includes lateral fluid intake ports 212.

An underflow tube 213 leads from the lower end of the separator 210 to a PCP or turbine pump 216 which receives fluid from the underflow tube 213 and directs it through outflow tubing 218. The outflow tubing 218 is sealed off against the wellbore 34 by packer 221 and may include a check valve and quick disconnect as described previously. The pump 216 is driven by a rotatable shaft 222 which is operated by a motor 214. The motor 214 may be similar to the motor 176 described previously with respect to FIG. 6. Fluid tubing 225 extends through dual packer 218 to supply fluid access to the motor 214 for gas located above the dual packer 217. One or more gas lift valves 220, of a type known in the art are mounted on the production tubing 36. The gas lift valves 220 receive gases which are pumped into the annulus formed by wellbore 34 and transmit the gases into the production tubing 36 to reduce the weight of the liquid in the tubing as is well known in the art. Motor exhaust gas tubing 223 extends from the lower portion of motor 214 to the production tubing 36 so that this gas may also be injected into the oil stream.

It is contemplated that the apparatus depicted in FIG. 7 will be used primarily where there is a significant amount of reservoir pressure applied by the surrounding formation to cause production fluid to be moved into the ports 212 and through the separator 210 for separation into its component concentrated oil and clean water streams. Movement of the production fluid is assisted to a minor degree by operation of the pump 216 which draws the clean water stream from the separator 210 through the underflow tube 213.

Operation of the apparatus shown in FIG. 7 is as follows. Gases are pumped from the surface downhole within the annulus formed by wellbore 34. The gases enter tubing 225 to drive motor 214 and cause the motor 214 to rotate the shaft 222. Rotation of the shaft 222 operates the pump 216 which helps draw production fluid from production perforations 30 into the separator 210 through ports 212. The separated clean water stream is directed through the underflow tube into pump 216 under suction provided by the pump 216. The pump 216 then pumps the clean water stream through outflow tubing 218 toward injection perforations 32. The concentrated oil stream which is separated by the separator 210 is directed into the production tubing 36 where it moves toward the surface of the well 20. Pumped gases from the annulus formed by wellbore 34 are transmitted into the production tubing 36 through the motor exhaust gas tubing 223 and the gas lift valves 220. Because the gases are substantially lighter than the concentrated oil within the production tubing 36, they assist in lifting the concentrated oil toward the surface of the well 20.

Figure 8:
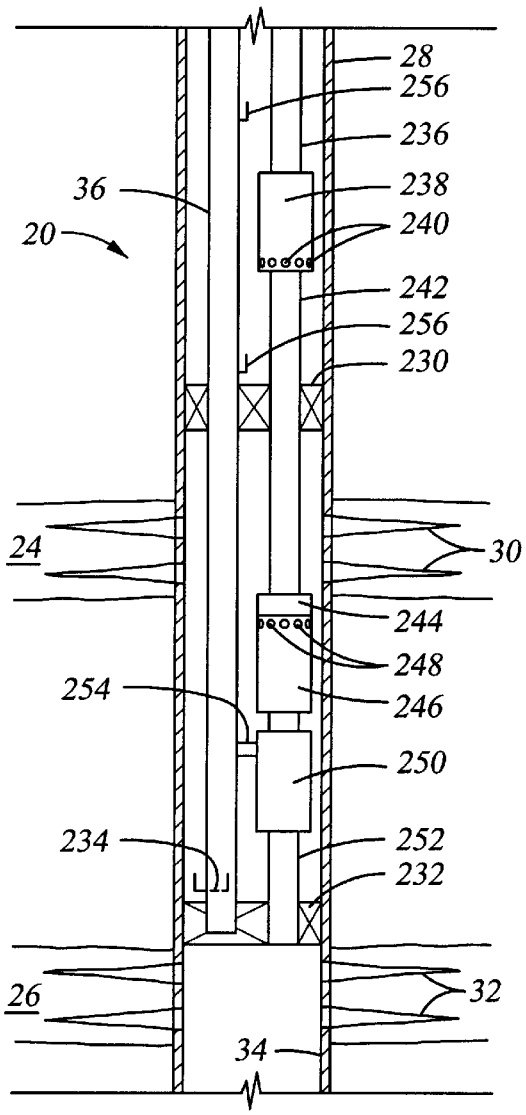
FIG. 8 is a partial cross-section which depicts a motor-pump-separator assembly in which the motor assembly is located within a drive portion of the annulus.

Referring now to FIG. 8, an alternative arrangement is depicted in which gas lift valves and pumped down gases are also employed to assist a concentrated oil stream toward the surface of well 20 for collection. However, the arrangement shown in FIG. 8 is one in which portions of the annulus formed by the wellbore 34 are dry, meaning that they contain no production fluid, although they will contain pumped down gas, such as methane. Production tubing 36 extends downward within the wellbore 34 through a dual packer or isolation cups 230 and is further seated at a lower location within lower packer 232 to close off the lower end of the production tubing 36. The production tubing 36 preferably includes a quick disconnect 234 just above the lower packer 232. The annulus formed by the wellbore 34 above packer 230 is dry. Between packers 230 and 232, however, the wellbore 34 contains production fluids supplied by production perforations 30.

In a side-by-side relation to the production tubing 36 is drive fluid supply tubing 236 which is adapted to transmit drive fluid, such as pumped hydraulic fluid, from the surface of well 20. The fluid supply tubing 236 is affixed at its lower end to a hydraulic motor 238 which has lateral hydraulic fluid exhaust ports 240 which permit hydraulic fluid which has been pumped through the motor 238 to enter the annulus provided by the wellbore 34 and thus return to the surface of the well 20. There may be return conduits (not shown) affixed to the exhaust ports 240 of motor 238 and extending to the surface of the well 20 through which the exhausted hydraulic fluid is directed to the surface.

The hydraulic motor 238 rotates shaft assembly 242 which is interconnected to seal/gearbox 244 which in turn drives pump 246. The hydraulic motor 238 may be a Centrilift Germia motor or an Inteq Netzch motor or other suitable hydraulic motor. The gearbox mechanism within the seal gearbox 244 may provide a 3:1 or 4:1 increase in rotation between the speed of rotation for shaft assembly 242 and the centrifugal pump shaft within pump 246. The pump 246 includes lateral fluid intake ports 248 through which production fluids from production perforations 30 may enter the pump 246. The pump 246 pumps production fluids entering the ports 248 into an affixed separator 250 which then separates the production fluid into a constituent concentrated oil stream and a clean water stream. The clean water stream is directed through outflow tubing 252 which extends through the packer 232 so that the clean water stream is directed toward injection perforations 32. The outflow tubing 252 may include a quick disconnect and check valve as previously described.

The concentrated oil stream is directed through a conduit 254 into production tubing 36 for transport to the surface of the well 20. Gas lift valves 256 are located on the outer surface of the production tubing 36 above the upper packer 230.

The following exemplary dimensions and specifications are provided for components in the arrangement depicted in FIG. 8 although these are not intended to limit the present invention. The casing for wellbore 34 has an internal diameter of 9⅝". Fluid supply tubing 236 has a 5" outer diameter. The production tubing 36 has a 2⅞" outer diameter. The hydraulic fluid supplied to the hydraulic motor 238 through fluid supply tubing 236 is supplied under a pressure of approximately 1000 psi.

In operation, the arrangement depicted in FIG. 8 functions as follows. Hydraulic drive fluid is pumped down fluid supply tubing 236 to operate hydraulic motor 238 and cause it to rotate shaft assembly 242. Rotation of the shaft assembly 242 operates the seal/gearbox 244 which, in turn, draws production fluid from production perforations 30 into intake ports 248 of the pump 246. The pump 246 pumps production fluid into the separator 250 which then separates the production fluid into a concentrated oil stream and a clean water stream. The clean water stream is directed through the outflow tubing 252 toward injection perforations 32.

The concentrated oil stream is directed from the separator 250 through lateral conduit 254 into the production tubing 36. The gas lift valves 256 serve to transmit pumped gas from the annulus formed by wellbore 34 into the production tubing 36 to assist in transporting the concentrated oil toward the surface of the well 20.

Several "uphole" arrangements are now described for reinjection of separated clean water into injection perforations which are located above, or uphole, from production perforations.

Figure 9:
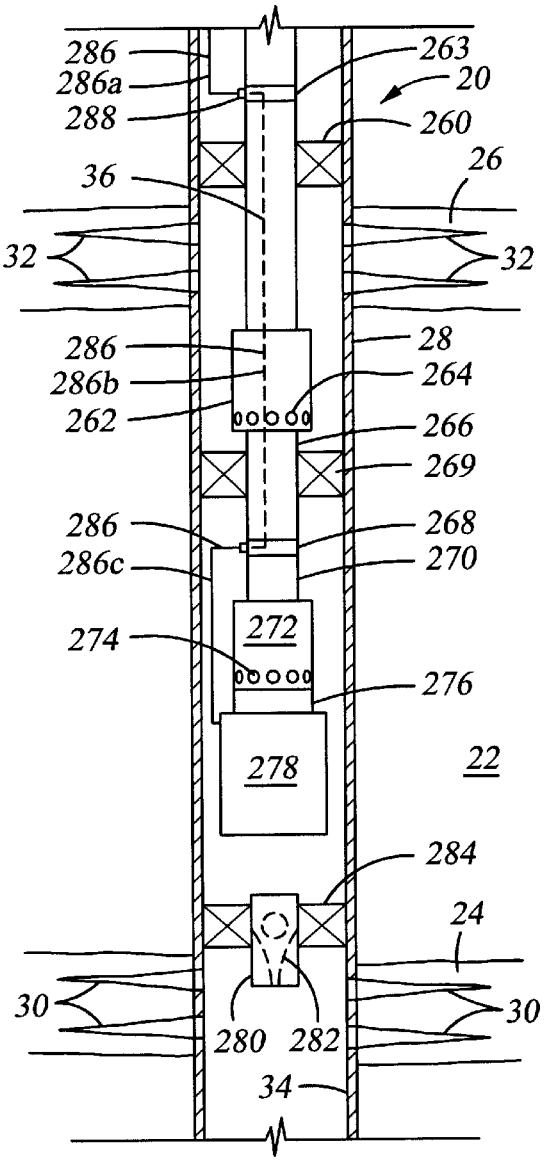
FIG. 9 is a partial cross-section which depicts a motor-pump-separator assembly in which the separator assembly releases the clean water stream laterally into the well annulus.
Figure 14:
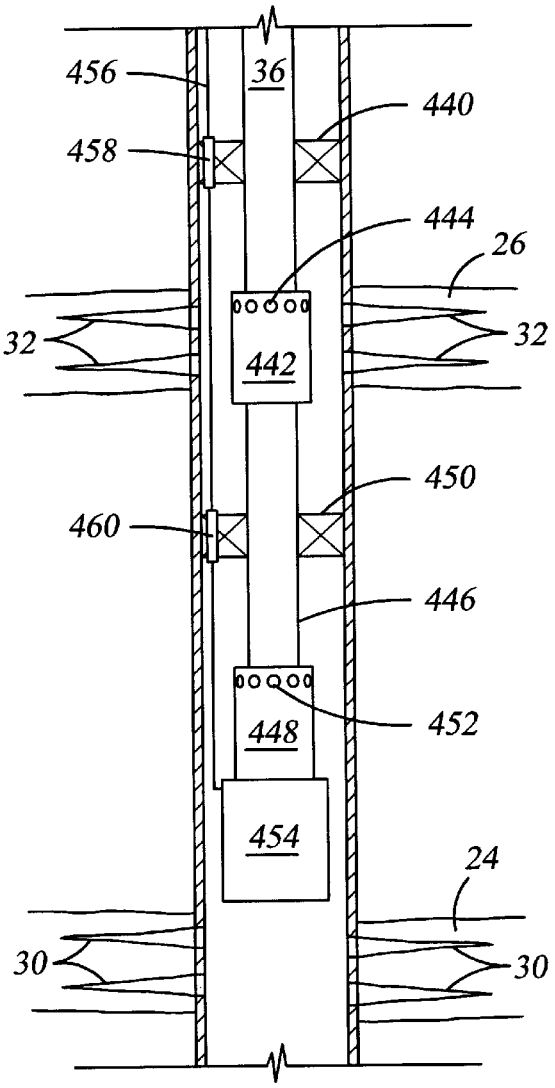
FIG. 14 is a partial cross-section of a further uphole arrangement.
Figure 15:
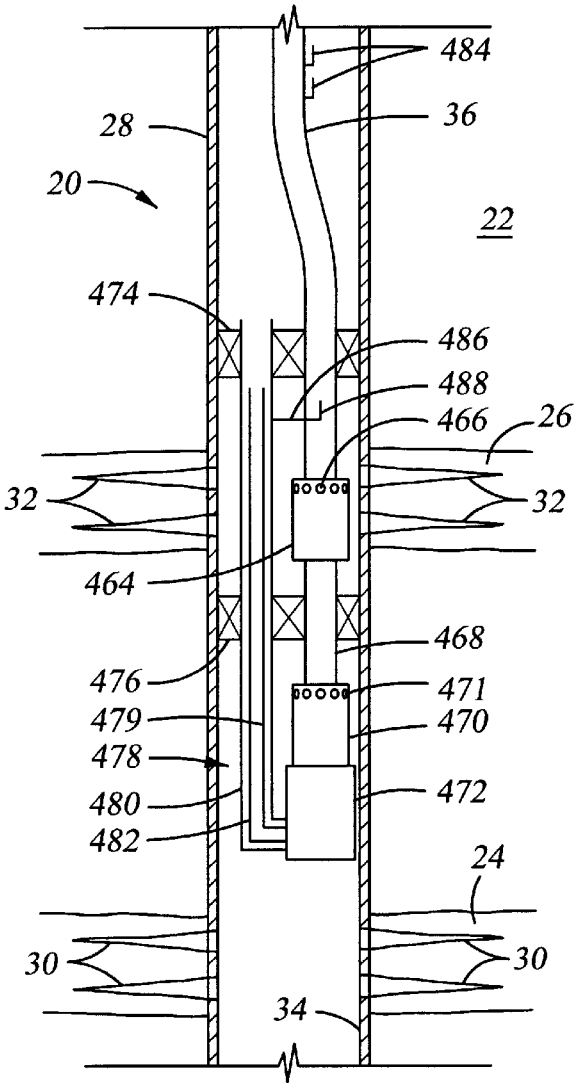
FIG. 15 is a partial cross-section showing another uphole arrangement.

Referring now to FIG. 9, the well 20 includes within its wellbore 34 a production tubing 36 which extends downwardly through an upper packer 260 and is affixed to a separator assembly 262. An upper feed-through sub 263 is interconnected within the production tubing 36, to connect cable from outside tubing 36 to inside tubing 36 in a manner which will be described shortly. The separator assembly 262 includes lateral fluid outlet ports 264 which are adapted to transmit separated clean water from within the separator 262 out into the annulus formed by the wellbore 34. A section of connecting tubing 266 is affixed to the lower end of the separator 262 and extends downward to a lower feed-through sub 268. The connecting tubing 266 is packed off against the casing 28 of well 20 by a packer 269. Another short section of tubing 270 interconnects the lower feed-through sub 268 to pump 272 which is preferably a multi-stage centrifugal pump 272. The pump 272 has lateral fluid intake ports 274 which are adapted to receive production fluid within the wellbore 34 from production perforations 30 and transmit it within the pump 272. The pump 272 is affixed by seal 276 to motor 278 which is operationally interconnected to drive the pump 272. Below the motor 278 is a section of tubing 280 containing an upwardly opening check valve 282. The tubing section 280 is packed off by packer 284 within the wellbore 34. The connecting tubing 266 and packer 269 isolate the disposal zone which includes production perforations 30. As shown in FIGS. 14 and 15, in other applications, the packer 284, check valve 282, and tubing section 280 may not be utilized.

Power is supplied to the motor 278 by means of a power cable 286 which extends downwardly from the surface of the well 20. An upper power cable section 286A extends from the surface of the well 20 and is disposed through a penetrator tube 288 in the upper feed-through sub 263. The upper power cable section 286A preferably has a rounded cross-section. It is pointed out that the power cable 286 is, in most cases, a larger composite cable made up of several smaller individual cables which are interwoven. It is highly preferred that, prior to the disposal of the cable section 286A into the upper feed-through sub 263, the individual cables making up cable section 286A be "unbundled" so that the intermediate cable section 286B does not present such a rounded cross section. This unbundling is accomplished by introduction of a device such as a Triskelion (not shown) into the cable section 286A. The Triskelion is available commercially from Quick Connectors, Inc. of Houston, Tex. Intermediate power cable section 286B extends from the upper feed-through sub 263 downward within production tubing 36 through the separator assembly 262 and tubing 266 to the lower feed-through sub 268. At the lower feed-through sub 268, the cable 286 is disposed outward through feed-through sub 268. The cable 286 continues as lower cable section 286C which extends from the lower feed-through sub 268 downward to the motor 278 where it is affixed to provide power thereto. The lower cable section 286C is preferably a flat cable which is more easily passed between the wellbore 34 and the interior components than a rounded cable. Placement of the cable section 286B within the production tubing 36, separator 262 and tubing 266 permits the cable to provide power to the motor 278 despite space restrictions imposed by the presence of these components within the wellbore 34. Further, the placement of the cable section 286B within the production tubing 36, separator 262 and tubing 266 obviates the need for specialized equipment such as packer penetrators to extend the cable 286 down to the motor 278.

In operation, the assembly depicted in FIG. 9 operates as follows. Power is supplied to the motor 278 via power cable 286 to drive the pump 272. The pump 272 draws production fluid from production perforations 30 upward through the check valve 282 and tubing 280 past the motor 278 and into intake ports 274. The pump 272 pumps production fluid through tubing 270 and 266 and into the separator 262.

The separator 262 separates the production fluid into a clean water stream and concentrated oil stream. The clean water stream is directed through lateral outflow ports 264 into the annulus formed by the wellbore 34 so that it will enter injection perforations 32. The concentrated oil stream is directed upward through production tubing 36 toward the surface of the well 20.

Figure 10:
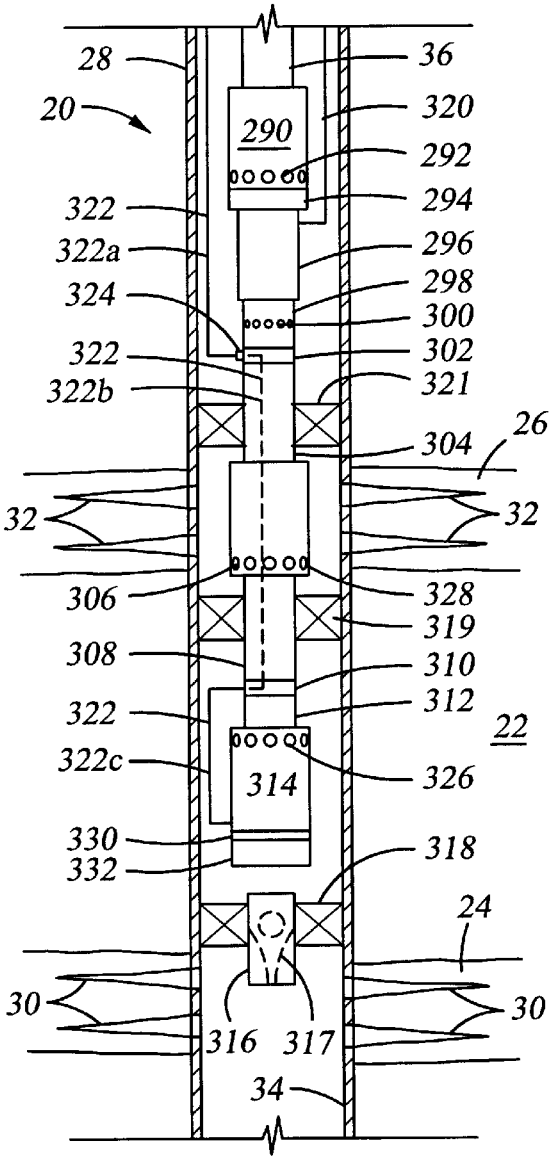
FIG. 10 is a partial cross-section which depicts use of a motor-pump-separator assembly above the upper packer of both the production and injection zones.

In FIG. 10, the wellbore 34 surrounds production tubing 36 which is affixed at its lower end to relay pump 290 which includes lateral intake ports 292 which are adapted to receive production fluid from production perforations 30 which are shown located at the lower portion of the wellbore 34. The relay pump 290 may be a multistage centrifugal pump or a PCP pump. The relay pump 290 is affixed by means of elastomer seal 294 to an upper motor 296. The upper motor 296 is an electrical submersible motor which is affixed at its lower end to a section of tubing 298 which includes lateral outflow ports 300. Tubing section 298 is affixed to an upper feed-through sub 302. Below upper feed-through sub 302 is a section of connecting tubing 304 which affixes the feed-through sub 302 to separator assembly 306. A further section of intermediate tubing 308 interconnects the separator 306 to lower feed-through sub 310. A further section of intermediate tubing 312 interconnects the lower feed-through sub 310 to a lower pump 314. The lower pump 314 is affixed by elastomer seal 330 to motor 332. An lower tubing section 316 is packed off by packer 318 below the motor 332. The lower tubing section 316 includes an upwardly opening check valve 317. Upper packer 321 seals off tubing 304 against the wellbore 34 and intermediate packer 319 seals off the tubing section 308 against the wellbore 34.

A power cable 320 supplies power from the surface of well 20 to the upper motor 296. Power cable 322 supplies power to the lower motor contained within pump-separator-motor assembly 314. Because of the presence of other components and packers 321 and 319, power cable 322 must be disposed within certain components in a manner similar to that of cable 286 shown in FIG. 9. Upper cable section is a flat section of cable extending downward from the surface of the well 20 to upper feed-through sub 302. A penetrator tube 324 is used to dispose the cable 322 through the upper feed-through sub 302. Intermediate cable section 322B extends between upper feed-through sub 302 and lower feed-through sub 310 within tubing 304, separator 306 and tubing 308.

In operation of the arrangement of FIG. 10, the lower pump assembly 314 draws production fluid from production perforations 30 through lower tubing section 316 and into intake ports 326. The production fluid is then directed upward through tubing sections 312 and 308 to separator 306. Following separation by separator 306, the clean water stream is directed laterally outward through fluid outflow ports 328 so that it may enter injection ports 32. The stream of separated concentrated oil is directed upward through tubing section 304 and 298 where it exits laterally through outflow ports 300 into the annulus formed by the wellbore 34 for upward movement and collection at the surface of the well 20.

Figure 11:
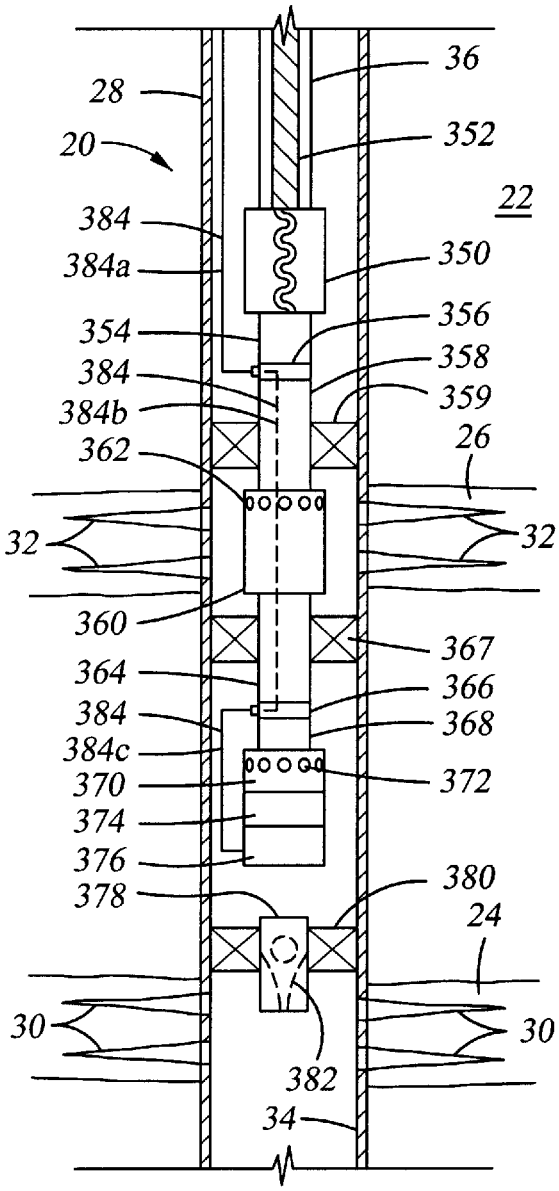
FIG. 11 is a partial cross-section which depicts an alternative embodiment for the motor-pump-separator assembly of FIG. 10 in which a dual opening packer is employed.

Referring now to FIG. 11, an arrangement is depicted which is similar in many respects to that shown in FIG. 10. Production tubing 36 extends downward within wellbore 34 and is connected at its lower end to a relay pump 350 which is a surface driven PCP pump. The relay pump 350 is driven by a shaft 352 which extends downward from the surface of well 20. Below the relay pump 350 is a section of tubing 354 which interconnects the pump 350 to an upper feed through sub 356 which is constructed in the same manner as upper feed through sub 302 described with respect to FIG. 10. Below the upper feed through sub 356 is intermediate tubing section 358 which extends downwardly to separator 360 having lateral fluid outlet ports 362. The intermediate tubing section 358 is packed off against casing 28 by packer 359. At the lower end of separator 360 is a flier portion of intermediate tubing 364 which interconnects the separator 360 to lower feed through sub 366. The intermediate tubing 364 is also packed off against casing 28 by a packer 367. The lower feed through sub 366, in turn, is affixed by tubing section 368 to pump 370 having lateral fluid intake ports 372; the pump 370 is affixed by elastomeric seal 374 to motor 376. At a point in the wellbore 34 below motor 376 a section of tubing 378 is packed off by packer 380 against wellbore 34. The tubing section 378 includes a check valve 382 which permits upward flow of fluid through the tubing section 378 but closes against downward fluid flow.

Power supplied to motor 376 by cable 384 which extends downwardly from the surface of the well 20. In a manner similar to that described with respect to cable 322, described in FIG. 10, power cable 384 is constructed of upper power cable section 384A which extends from the surface of well 20 to upper feed through sub 356 where it passes through the wall of the feed through sub 356. Intermediate cable section 384B extends between the upper feed-through sub 356 and lower feed-through sub 366 radially within tubing section 358, separator 360 and tubing section 364. At lower feed through sub 366, the cable section 384B is passed through the wall of feed through sub 366. Lower cable section 384C then extends from the lower feed through sub 366 downward to motor 376 to supply power thereto.

The arrangement depicted in FIG. 11 operates substantially as follows. The lower pump 370 draws production fluid from production perforations 30 through tubing section 378 and into fluid intake ports 372. The lower pump 370 then pumps production fluid upward through tubing sections 368 and 364 to separator 360. The separator 360 then separates the production fluid in a manner previously described into a clean water stream and a concentrated oil stream. The clean water stream is then directed laterally outward through fluid output ports 362 toward injection perforations 32. The concentrated oil stream is directed upward through tubing section 358 and 354 to the upper pump 350 which conveys the concentrated oil toward the surface of well 20 through production tubing 36.

Figure 12:
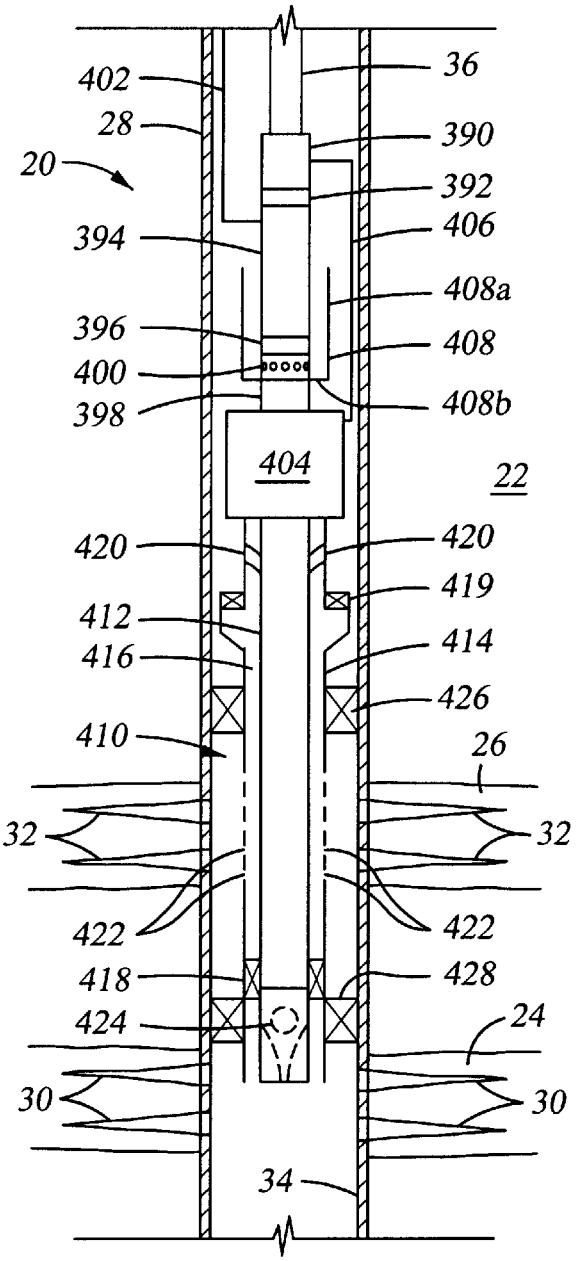
FIG. 12 is a partial cross-section which depicts a motor-pump-separator assembly in conjunction with a concentric, dual-shell tubing section.

Referring now to FIG. 12, production tubing 36 extends downward within wellbore 34 of well 20. At the lower end of production tubing 36 is affixed a relay pump 390 which can be a centrifugal pump or a PCP pump. The lower end of relay pump 390 is affixed by elastomer seal 392 to motor 394. The lower end of motor 394 is affixed by elastomeric seal 396 to pump 398 having lateral fluid intake ports 400. Power is supplied to the motor 394 by power cable 402 which extends downward from the surface of the well 20. A separator 404 is affixed to the lower end of primary pump 398. An oil conduit 406 interconnects the separator 404 and the relay pump 390. A shroud 408 surrounds the motor 394 and the upper portion of pump 398, the shroud 394 being closed at its lower end 408 being against fluid flow as shown. The upper end 408A is not sealed against fluid flow and fluid may enter the radial interior of shroud 408 through the upper end 408A.

Below the separator 404 is connected a section of concentric tubing 410 having a dual walled structure. The concentric tubing section 410 contains a radially inner tubing segment 412 and a radially outer tubing segment 414 because the inner tubing segment 412 is disposed within outer tubing segment 414, it forms an annulus 416 between the two tubing segments. An annular elastomeric seal 418 is disposed within the annulus 416 toward the lower end of concentric tubing segment 410. A cross-over 420 is located at the upper end of the concentric tubing segment 410. A cross-over permits fluid communication between the interior of radially inner tubing section 412 and the wellbore 34 radially outward of the outer tubing segment 414 without blocking fluid flow along the annulus 416 formed by the inner and outer tubing segments 412, 414. Another annular seal 419 is located proximate the top of the tubing section 410. The upper seal 419 is located radially outside of the annulus 416, as shown, to leave the annulus 416 open to fluid flow therethrough. Lateral fluid ports 422 are disposed through the wall of outer tubing segment 414. Contained radially within the inner tubing segment 412 is a check valve 424 which opens to permit fluid flow upward within the interior tubing segment 412 but which also closes against downward fluid flow through tubing segment 412. Packers 426 and 428 secure the concentric tubing section 410 within the wellbore 34.

It is preferred that oil conduit 406 extends between the separator 404 and relay motor 390 within the confines of shroud 408. There may be insufficient space depending upon the particular dimensions of well 20, to permit the oil conduit 406 to be disposed between the outer wall of shroud 408 and wellbore 34.

In operation, production fluid from production perforations 30 is drawn upward through check valve 424 and into inner tubing segment 412. The production fluid then passes via cross over 420 from the interior of tubing segment 412 and into the wellbore 34. Production fluid then flows upward around the upper end 408A of shroud 408 and is drawn into the intake ports 400 for the primary pump 398. The pump 398 pumps the production fluid through separator 404. The separator 404 then separates the production fluid into a concentrated oil stream and clean water stream as described previously. The concentrated oil is directed through oil conduit 406 from the separator 404 to relay pump 390 which conveys the oil to the surface of the well 20 via production tubing 36.

The produced clean water exits the separator 404 and enters the annulus 416 formed between the inner tubing member 412 and outer tubing member 414. The clean water then passes outward through ports 422 to be absorbed into injection perforations 32.

The arrangement depicted in FIG. 12 is particularly appropriate where a smaller casing for wellbore 34, such as a 5½ inch diameter casing is used. In such cases, use of a "dual packer" in which the packer permits two tubular members to be passed therethrough, is impractical presently in wellbores having such a small casing diameter.

Figure 13:
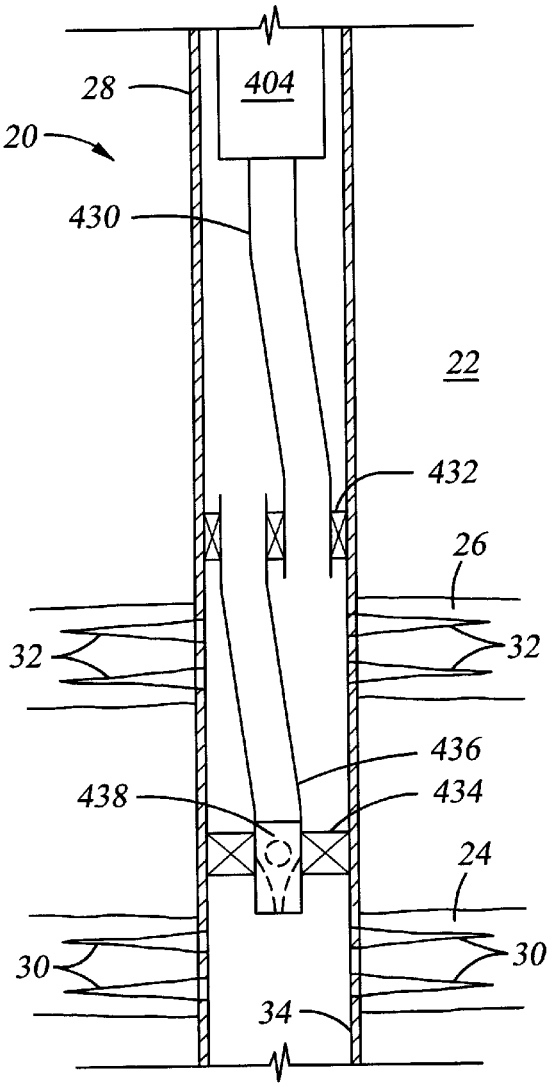
FIG. 13 is a partial cross-sectional view of an alternative design for the lower portions of the arrangement shown in FIG. 12.

Referring now to FIG. 13, an alternative embodiment of the apparatus depicted in FIG. 12 is shown which is suitable for wellbores having larger casing diameters such as 7 inches or 9⅝ inches. Because construction of this apparatus is identical to that shown in FIG. 12 from separator 404 upward, those portions will not be again described and, consequently, only those components downward from the separator are described in detail. Intermediate tubing section 430 extends downward from the lower end of separator 404 and through dual packer 432. Tubing section 430 is adapted to carry the clean water stream from separator 404 downward below the dual packer 432 so that it might enter injection perforations 32. A lower packer 434 is located above production perforations 30 but below injection perforations 32. A section of intermediate tubing 436 extends through the dual packer 432 and lower packer 434 and includes a check valve 438 which will open to permit flow of fluids upward through tubing section 436 but which will close to downward flow through the tubing section 436.

The arrangement depicted in FIG. 13 permits production fluids from production perforations 30 to bypass the seals provided by packers 432, 434 and reach the motor 394 as shown in FIG. 12.

Turning now to FIG. 14, an arrangement is shown in which production tubing 36 is disposed within the wellbore 34 of well 20. The production tubing 36 passes through an upper packer 440 and is connected at its lower end to separator 442. The separator 442 includes fluid outlet ports 444 laterally disposed at its upper end. Below the separator 442 a section of tubing 446 interconnects the separator 442 to pump 448 which is located below a lower packer 450. The pump 448 includes lateral fluid intake ports 452 and is affixed at its lower end to a motor 454 which operates the pump 448. A power cable 456 extends from the surface of the well 20 down within the wellbore 34 to supply power to the motor 454. Penetrators 458 and 460 are used to pass the power cable 456 through the upper packer 440 and lower packer 450 as shown. Preferably, the section of cable 456 which is located between upper penetrator 458 and lower penetrator 460 has a flat cross section so that it may be more easily disposed between the casing of wellbore 34 and separator 442. It is contemplated that the assembly of FIG. 14 will be used in applications in which the casing for the wellbore 34 has an interior diameter of 7 inches or 9⅝ inches.

In operation, the pump 448 draws production fluid from production perforations 30 in through intake ports 452 and pumps the production fluid upward through tubing section 446 to separator 442. The separator 442 then separates the production fluid into concentrated oil and clean water. The concentrated oil is then directed toward the surface toward production tubing 36. Meanwhile, the clean water stream is then directed through lateral out flow ports 444 so that it might enter injection perforations 32.

Turning now to FIG. 15, a further uphole arrangement is described which incorporates gas lift valves. The well 20 includes a wellbore 34 which encloses the production string 36. The production string 36 is affixed at its lower end to a separator 464 having lateral fluid outflow ports 466. A section of tubing 468 connects the separator 464 at its lower end to pump 470 which may be a centrifugal pump, PCP pump or other suitable pump. The pump 470 is driven by motor 472 which is affixed to the pump at its lower end. An upper dual packer 474 is disposed within the wellbore 34 above the location of injection perforations 32. Lower packer 476 is disposed within the wellbore 34 below the location of injection perforations 32 but above production perforations 30. A dual shelled concentric tubing section 478 leads from motor 472 through lower packer 476 and upward through upper packer 474. The concentric tubing section 478 includes an inner piping section 479 and a radially outer piping section 480 there being an annulus 482 formed therebetween. Gas lift valves 484 are located on the exterior surface of production tubing 36 above the location of upper packer 474. A lateral tube 486 extends from concentric tubing section 478 into the production tubing 36. The lateral tube 486 presents an upturned end or nozzle 488.

Above the location of upper packer 474, the wellbore 34 is pressurized. The wellbore 34 is preferably formed by 9⅝ inch diameter casing.

In operation, gases which are pumped down within wellbore 34 enter the inner piping section 479 of concentric piping section 478. The gases then cause gas powered motor 472 to operate and drive pump 470. The pump 470 draws production fluid from production perforations 30 inward through lateral fluid intake ports 471. The pump 470 then pumps the production fluid upward through piping segment 468 into separator 464. The separator 464 then separates the production fluid into concentrated oil and clean water, as described previously. Separated concentrated oil is then directed upward into production tubing 36. Gas entering production tubing 36 through gas lift valves 484 helps raise the concentrated oil to the surface of the well 20. Separated clean water is directed through lateral outflow ports 466 so that it may enter the injection perforations 32 in the disposal zone 26.

Figure 16:
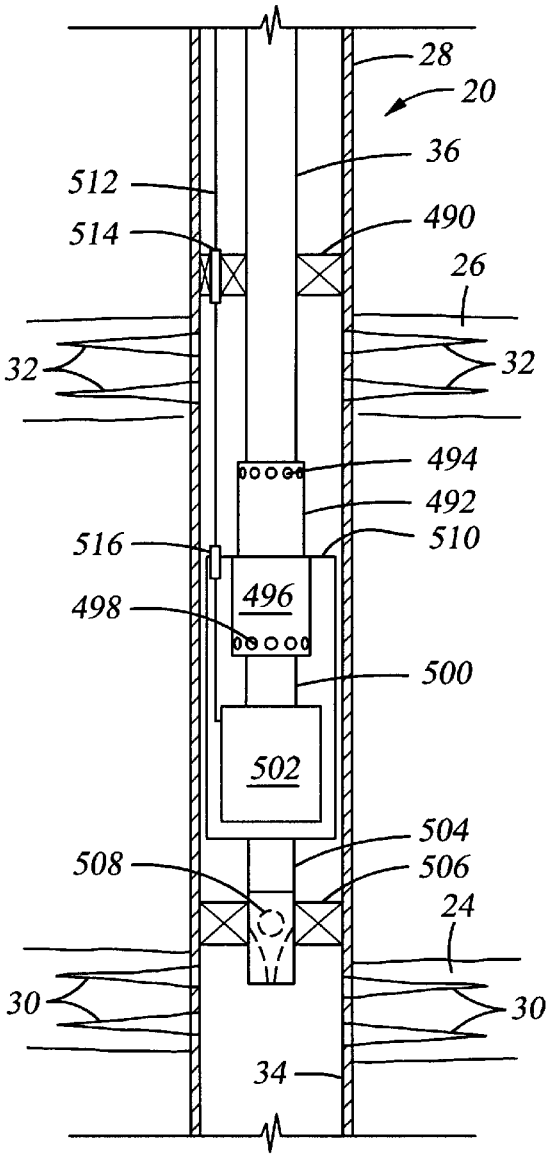
FIG. 16 is a partial cross-section showing an uphole arrangement in which the pump and motor are surrounded by a housing.

Referring now to FIG. 16, well 20 is shown to contain a wellbore 34 which surrounds production tubing string 36 which extends through upper packer 490 and is affixed at its lower end to separator 492 having lateral fluid outlet ports 494. The separator 492 is affixed to pump 496 having lateral fluid intake ports 498. The pump 496 is affixed at its lower end to motor 502. An elastomer seal 500 may also be incorporated. Beneath motor 502 is a tubing section 504 which extends through a lower packer 506 and contains a check valve 508 which permits upward flow of fluids through tubing section 504 but will close against a downward flow of fluids. A fluid-tight enclosure or housing 510 surrounds the pump 496, seal 500 and motor 502. A power cable 512 extends downward from the surface of the well 20 and passes through upper packer 490 with the aid of a penetrator 514. A second penetrator 516 is used to pass the cable 512 through the housing 510 so that it may extend to motor 502.

In operation, production fluid drawn from production perforations 30 passes through tubing section 504 upwardly into the housing 510 and enters fluid intake ports 498 of pump 496. The pump 496 then pumps the production fluid into separator 492 which separates the production fluid into a clean water stream and concentrated oil stream. The clean water stream is disposed through lateral exit ports 494 so that it may enter injection perforations 32. The concentrated oil stream is disposed upward through production tubing 36 so that it may be collected at the surface of the well 20.

Figure 17:
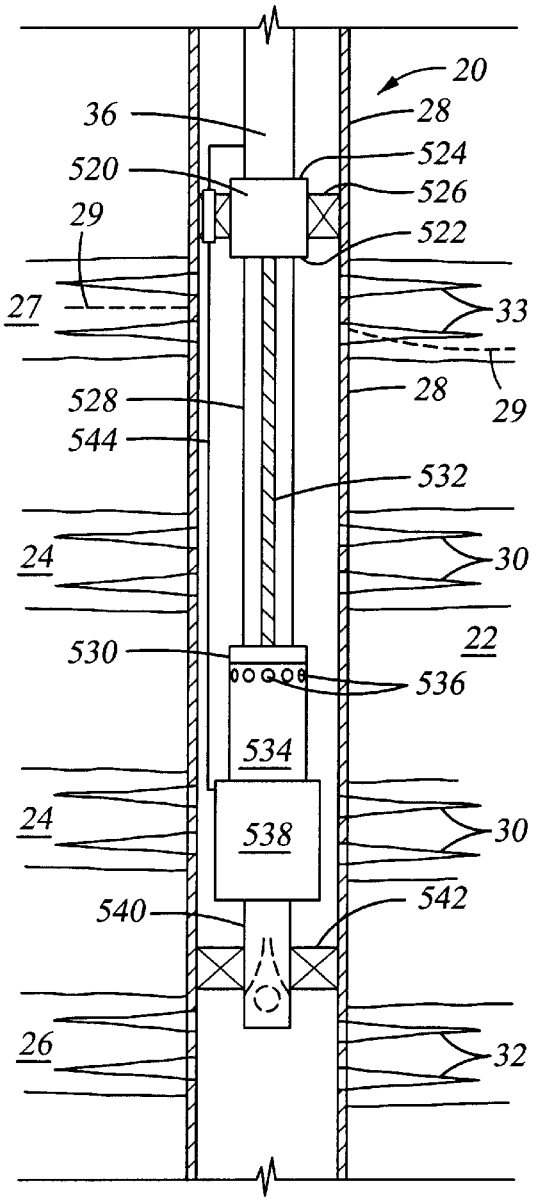
FIG. 17 is a partial cross-section of a motor-pump-separator assembly having the motor driven by formation gases.

Turning now to FIG. 17, an apparatus is described for use in a well 20 which includes liquid production perforations 30, injection perforations 32 and gas production perforations 33 which are located within the wellbore 34 above the liquid production perforations 30. The gas perforations 33 are associated with a gaseous production zone 27 in the surrounding formation 22. A gas/liquid interface 29 exists between the gaseous production zone 27 and production fluid within formation 22. Gas above the interface 29 enters the wellbore 34 through the gas perforations 33 under formation pressure. The arrangement depicted in FIG. 17 is useful when it is desired to remove the gas within gaseous zone 27 either by venting it off at the surface or otherwise collecting it.

At the lower end of production tubing 36 in wellbore 34 is a gas driven motor 520 having a gas receiving inlet 522 proximate its lower end and a gas outlet 524 at its upper end. A packer 526 seals off the outer surface of the motor 520 against the interior of wellbore 34. An intermediate tubing section 528 extends from the lower end of motor 520 to gear box 530 below. The motor operates shaft 532 via rotation which in turn rotates gears within gear box 530 to operate pump 534 affixed to the gear box 530. The pump 534 has lateral fluid intake ports 536 which are adapted to receive production fluid from fluid production perforations 30. A fluid separator 538 is operatively associated with the pump 534 at its lower end. Fluid outlet tubing 540 extends from the lower end of the separator through the packer 542. As previously described, the fluid output tubing 540 may include a check valve and quick disconnect mechanism. Concentrated oil conduit 544 extends from the separator 538 upward to production tubing 36. The concentrated oil conduit 544 passes through the upper packer 526 using one of the techniques previously described.

The assembly in FIG. 17 draws production fluid from liquid production perforations 30 and provides it to the surface of the well 20 through production tubing 36. In so doing, the assembly reduces the pressure within the wellbore 34 between the packers 526 and 542 and draws down the level of liquid in the surrounding formation 22 to permit gas from the gaseous zone 27 to enter perforations 33 into the annulus formed by wellbore 34. Under pressure from within formation 27, gas passes through the motor 520, thus driving the motor 520 and exhausting through the gas outlet 524 into the annulus above the packer 526.

In operation, motor 520 receives gas through gas inlet 522 and expels it through 524 to rotationally drive shaft 532 through gear box 530 and cause operation of pump 534. Pump 534 draws production fluid from production perforations 30 inward through intake ports 536. The pump 534 then pumps the production fluid through the separator 538. Separated clean water is disposed through fluid output tubing 540 while separated concentrated oil is disposed through tubing 544 to production tubing 36 where it is transported toward the surface of well 20.

Figure 18:
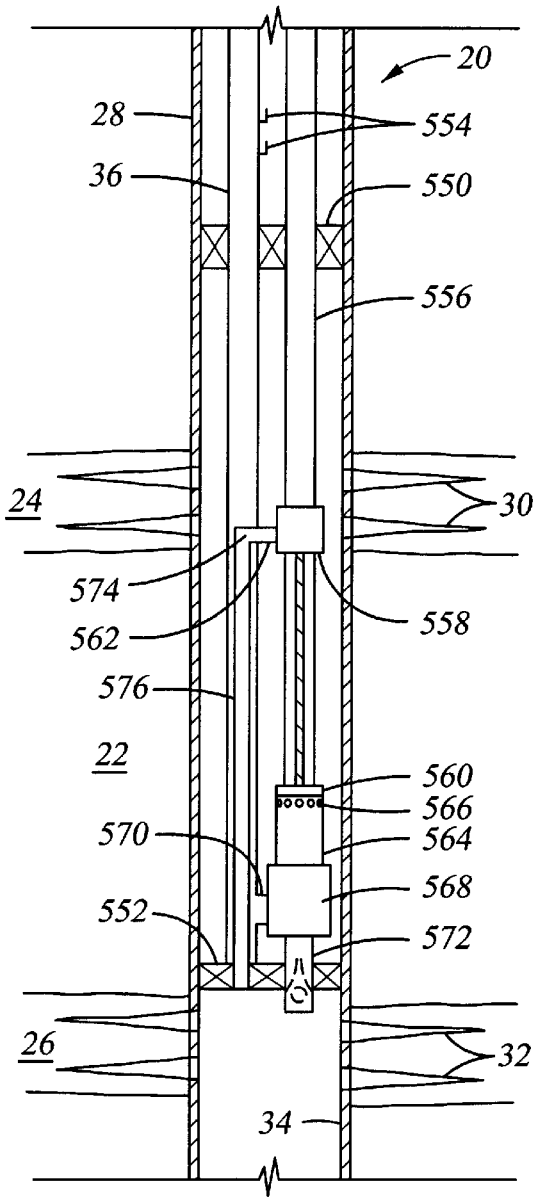
FIG. 18 is a partial cross-section of a motor-pump-separator assembly having a fluid driven motor.

Referring now to FIG. 18, an alternative arrangement is shown in which a motor for a motor-pump-separator assembly is operated using liquid injection techniques. The arrangement directs both injected water from the motor exhaust as well as separated, produced water from the separation process toward the injection perforations for introduction into a disposal zone. As shown in FIG. 18, the well 20 includes a wellbore 34 having production perforations 30 and injection perforations 32 arranged in a downhole fashion so that the injection perforations are below, or downhole from, the production perforations 30. Production tubing 36 extends downwardly through an upper packer 550 to lower packer 552 against which the production tubing 36 seals. Both upper packer 550 and lower packer 552 are dual packers which permit two tubular members to be disposed therethrough. The outer surface of production tubing 36 above the upper packer 550 includes one or more gas lift valves 554 disposed on the outer surface of the production tubing 36 which are adapted to permit transfer of gases from the annulus formed by wellbore 34 into the production tubing 36. Arranged in a side by side relation to production tubing 36 is fluid tubing 556 which extends downwardly from the surface of well 20. Fluid tubing 556 penetrates the upper packer 550 and is operably affixed to a fluid motor 558 of a type known in the art. The fluid motor 558 receives fluid from the fluid tubing 556 and, in turn, operates gear box 560 affixed below. The motor 558 also has fluid exhaust tubing 562 which, preferably, exits the motor 558 in a lateral fashion. Operably associated with gear box 560 is pump 564 having lateral fluid intake ports 566. Below the pump 564 is affixed separator 568 having a concentrated oil outlet tube 570 and fluid outlet tubing 572 at its lower end. Fluid outlet tubing 572 penetrates the lower packer 552 and, as previously described, may incorporate a check valve and quick disconnect. Lateral tubing 562 exiting from the motor 558 penetrates the wall of production tubing 36 as shown in FIG. 18 and bends at elbow 574 downwardly to become inner concentric tubing section 576 which is located radially within the lower section of production tubing 36. Inner tubing section 576 penetrates the lower packer 552 so that fluid within the inner tubing section 576 can be disposed through the lower packer 552.

In operation, an injection liquid, preferably sea water or another readily available liquid, is pumped down through tubing 556 to operate motor 558. The motor 558 in turn operates gear box 560, pump 564 and separator 568 to separate oil and water from production fluid coming from production perforations 30 in a manner heretofore described. Separated clean water is disposed through tubing 572 toward injection perforations 32. Concentrated oil is disposed through conduit 570 and into production tubing 36 where it is transported toward the surface of the well. Transport of the concentrated oil within production tubing 36 may be assisted by gas entering the production tubing 36 through gas lift valves 554.

Fluid injected along tubing 556 into motor 558 is exhausted through exhaust tubing 562, elbow 574 and tubing 576 and ultimately disposed below lower packer 552 to be directed toward injection perforations 32.

Figure 19:
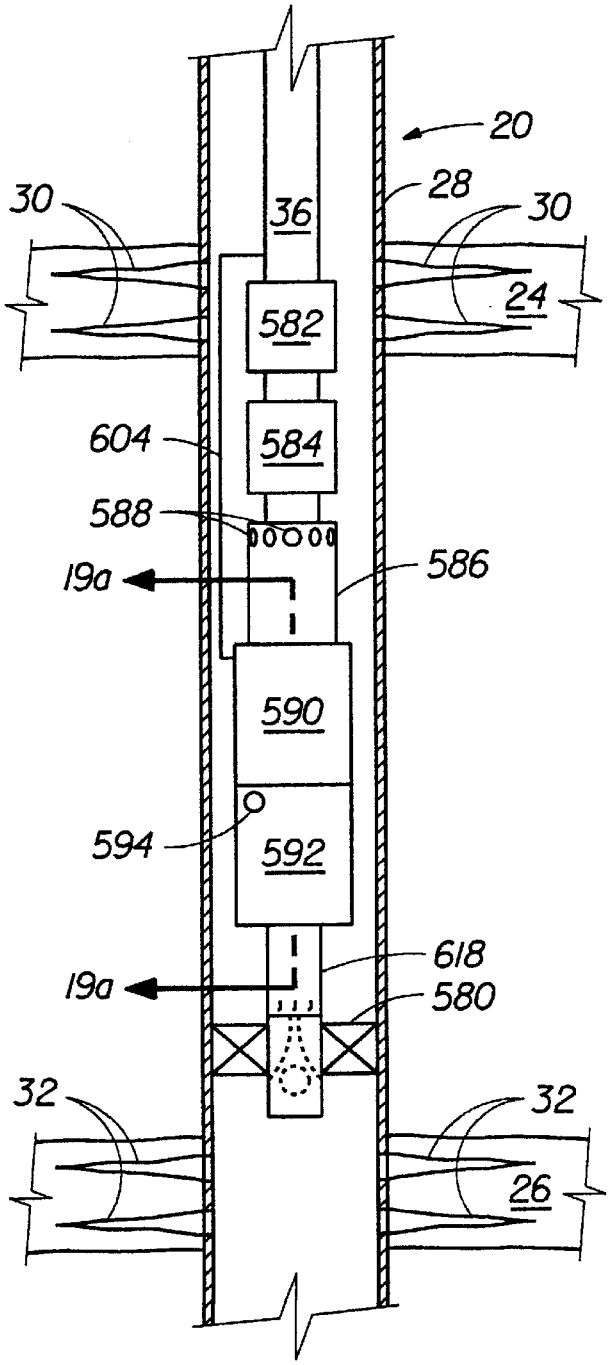
FIGS. 19 and 19A are partial cross-sections of a system incorporating an exemplary multiple hydrocyclone separator assembly in which a separated dry oil stream is recycled by commingling with production fluid.
Figure 19A:
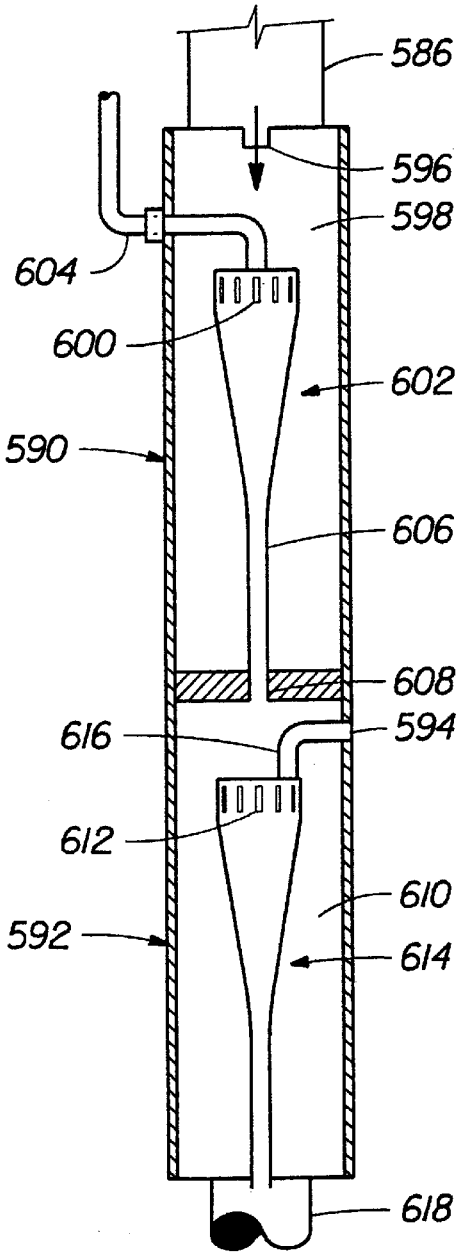

Referring now to FIGS. 19 and 19A, a multiple stage hydrocyclone arrangement is depicted. Well 20 includes wellbore 34 wherein production perforations 30 are separated from injection perforations 32 by a single packer 580. Production tubing 36 extends downwardly from the surface of well 20 to a motor 582 which is interconnected to pump 586. The interconnection may include an intermediate seal 584. The pump 586 has fluid intake ports 588 and is affixed at its lower end to an upper fluid separator assembly 590 which, in turn, is affixed at its lower end to lower fluid separator assembly 592. The lower fluid separator 592 includes lateral fluid outlet ports 594. With reference to FIG. 19A, the internal structure and interconnection of separators 590 and 592 is apparent. An inlet tube 596 transmits fluid from the pump 586 into a chamber 598 within the upper separator assembly 590. Production fluid within chamber 598 enters the lateral fluid inlets 600 of a first hydrocyclone 602. Once within the first hydrocyclone 602, concentrated oil is separated and transmitted via concentrated oil tube 604 upwardly toward production tubing 36. Clean water separated by the first hydrocyclone 602 enters underflow tube 606 and is transmitted through intermediate conduit 608 to the second separator assembly 592.

The second separator assembly 592 also includes an interior chamber 610 into which the separated clean water from the first hydrocyclone assembly will flow. In the same manner as production fluid in chamber 598, separated water in chamber 610 enters lateral fluid inlets 612 in second hydrocyclone 614. Concentrated oil which is separated from that fluid is directed through lateral outlet tube 616 and outlets 594. The separated water is disposed through lower fluid output tube 618 which penetrates packer 580.

Figure 20:
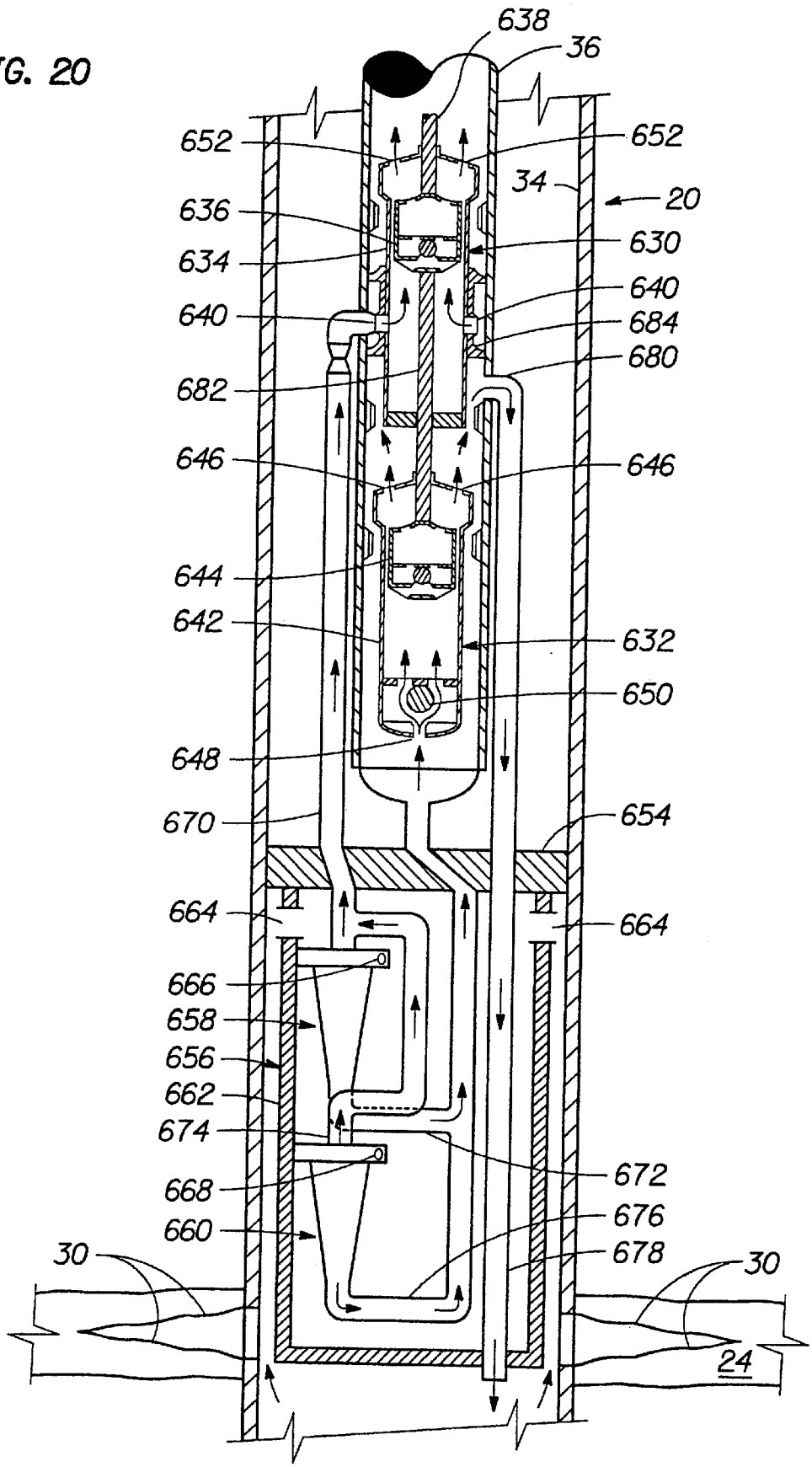
FIG. 20 is a partial cross-section of a motor-pump-separator system incorporating a beam or rod pump.

FIG. 20 depicts the details of operation of multiple stage hydrocyclones by a rod or beam pump. Within the wellbore 34 of well 20 is production tubing 36 which encases an upper beam pump 630 and lower beam pump 632. The upper beam pump 630 includes an upper cylinder 634 within which is disposed an upper piston 636. The piston 636 is interconnected to drive rod 638 which extends downwardly from the surface of well 20 to reciprocate the piston 636 within the upper cylinder 634. Intake ports 640 are disposed through the walls of the cylinder 632. A lower beam pump 632 includes a lower cylinder 642 within which a lower piston 644 is retained and moveable within cylinder 642 in a reciprocating manner. Lower cylinder 642 includes upper discharge ports 646 and at least one lower intake port 648 which leads to a check valve 650 which opens to permit flow upward through intake port 648 into cylinder 642 but will close against downward flow in the opposite direction. The cylinder 634 of upper pump 630 includes exit ports 652 at its upper end through which fluid exits the pump 630 into production tubing 36. Beneath the pumps 630, 632 is packer 654. It is noted that the two pumps 630, 632 are separated against fluid transfer by a seal 684.

A separator assembly 656 includes a first upper separator 658 and a second lower separator 660, each of these being hydrocyclone-type separators. The separator assembly 656 includes an outer housing 662 having lateral intake ports 664 disposed therethrough. Each hydrocyclone 658, 660 includes at least one lateral intake port, 666, 668 proximate its widened top. The upper hydrocyclone 658 includes an overflow tube 670 which extends from the upper portion of hydrocyclone 658 to the intake ports 640 on upper pump 630. The upper hydrocyclone 658 also includes underflow tubing 672 which extends outwardly from the lower end of the hydrocyclone 658. The lower hydrocyclone 660 includes overflow tubing 674 which extends upwardly from the top of the hydrocyclone 660 and adjoins tubing 670 above the top of the upper hydrocyclone 658. Lower hydrocyclone 660 also includes underflow tubing 676 which extends from the lower end of the lower hydrocyclone 660 upwardly to feed into the fluid intake port 648 of the lower pump 632. A fluid manifold 678 extends from an outlet 680 in production tubing 36 downwardly through seal 654 and the housing 662 of separator assembly 656.

In operation, reciprocation of the rod 638 from the surface of well 20 moves the piston 636 of upper pump 630 and piston 644 of lower pump 632 together in a reciprocating manner due to interconnection of the pistons 644, 636 by a connecting rod 682. As the pistons 644, 636 are moved upwardly within their cylinders, production fluid from production perforation 30 enters fluid ports 664 and fluid inlets 666, 668 of hydrocyclone 658, 660. Concentrated oil separated by the hydrocyclone 658, 660 is disposed through tubing 670, 674 to fluid intake ports 640 where it is pumped by upper pump 630 toward the surface of well 20. Clean water separated by hydrocyclone 658, 660 exits the hydrocyclones through underflow tubing 672, 676 to enter the fluid intake port 648 of the lower pump 632. From there, the separated water is disposed through lateral port 680 and is directed via discharge manifold 678 toward injection perforations (not shown).

Figure 22:
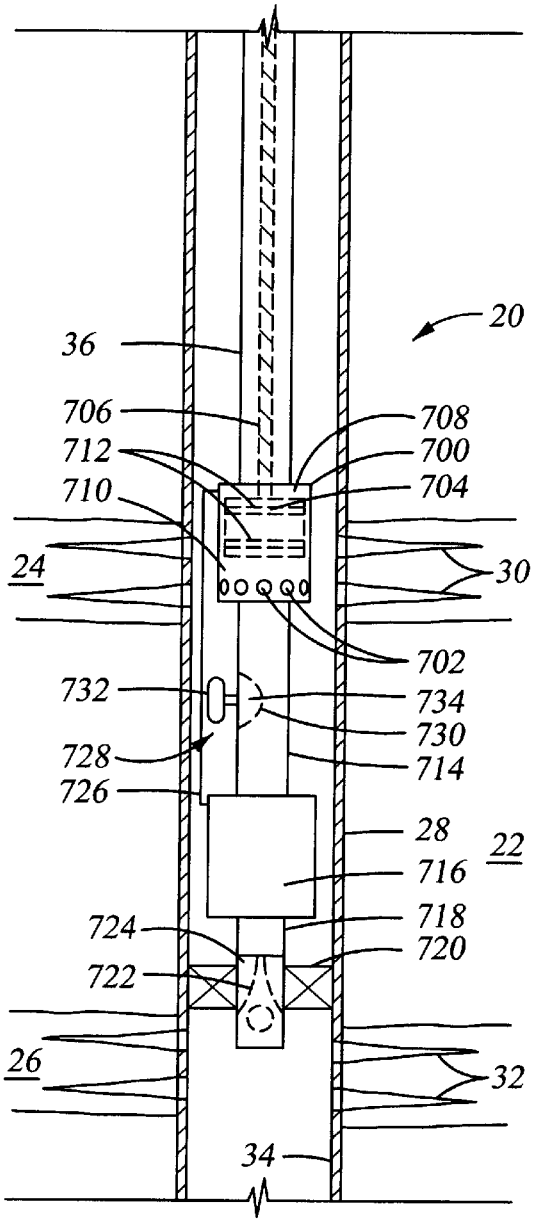
FIG. 22 is a partial cross-section of hydrocyclone separator assembly operated within a wellbore by a beam or rod pump.

Referring now to FIG. 22, an arrangement is shown whereby a surface driven beam or rod pump is operationally interconnected to a separator arrangement so that production fluid is both pumped into the separator arrangement by beam pump and also concentrated oil is drawn from the separator by the same pump and pumped toward the surface of the well. Production tubing 36 extends downwardly within the wellbore 34 of well 20 and is affixed at its lower end to a beam pump 700 which has one or more fluid intake ports 702 proximate its lower end. The fluid intake ports 702 are each equipped with a one-way check valve (not shown) which permits fluid to enter the pump 700 from the wellbore 34 but which closes under pressure from within the pump 700 to prevent fluid from exiting from the ports 702 back into wellbore 34. The pump 700 includes a piston 704 which is driven by shaft 706 which extends downwardly from the surface of the well 20. The pump 700 includes an upper fluid chamber 708 located above the piston 704 and a lower chamber 710 located below the piston 704. Annular seals or rings 712 about the periphery of piston 704 which prevent fluid transfer between the upper chamber 708 and lower chamber 710. Fluid conduit 714 extends from the lower portion of pump 700 to separator 716 below. Fluid conduit 714 permits fluid transfer from the lower chamber 710 of pump 700 into the separator 716. Outflow tubing 718 is located below separator 716 and is packed off by packer 720. The outflow tubing 718 includes a check valve 722 and may include a quick disconnect 724. Fluid tubing 726 extends from the separator 716 upward to the upper chamber 708 of pump 700. Preferably, a check valve (not shown) is included within tubing 726 such that fluid transfer is permitted from the separator 716 into the upper chamber 708 but not in the opposite direction.

Preferably, a vibration dampener, shown generally at 728 is incorporated into fluid tubing 714. The vibration dampener 728 includes a flexible bladder 730 which is affixed to the inner surface of tubing 714 in a fluid tight manner. A pressure source 732 provides fluid under pressure to fill the interior 734 of bladder 730.

In operation, beam 706 is reciprocated or moved in an upward or uphole direction such that the piston 704 is moved upwardly. The upward movement of piston 704 draws production fluid which has been produced from production perforations 30 inward from the annulus formed by wellbore 34 through intake ports 702 and into the lower chamber 710. As the beam 706 and piston 704 are then moved downwardly, the check valve incorporated in fluid intake ports 702 closes to block movement of fluid from the lower chamber 710 outward into wellbore 34. The fluid in lower chamber 710 is then pumped downward through tubing 714 to separator 716.

The vibration dampener 728 damps systemic vibrations which result from variations in the flow rate of production fluid through tubing 714. A partial blockage of the tubing 714 caused by the bladder 730 permits some flow past the bladder 730 although at a somewhat restricted rate. As flow through tubing 714 increases due to the pumping by pump 700 as described above, pressure within the interior 734 of bladder 730 provided by pressure source 732 maintains the bladder in a relatively inflated condition to maintain the flow rate through tubing 714 at a relatively constant reduced rate.

As production fluid is flowed through tubing 714 and enters separator 716, it is separated as previously described into a concentrated oil stream and a clean water stream. The clean water stream is directed through outflow tubing 718 so that it may enter injection perforations 32 in disposal zone 26. The concentrated oil stream is directed through tubing 726 upward into upper chamber 700. As the piston 704 is reciprocated upwardly, concentrated oil with the upper chamber 708 is pumped upwardly through production tubing 36 toward the surface of well 20.

Figure 23:
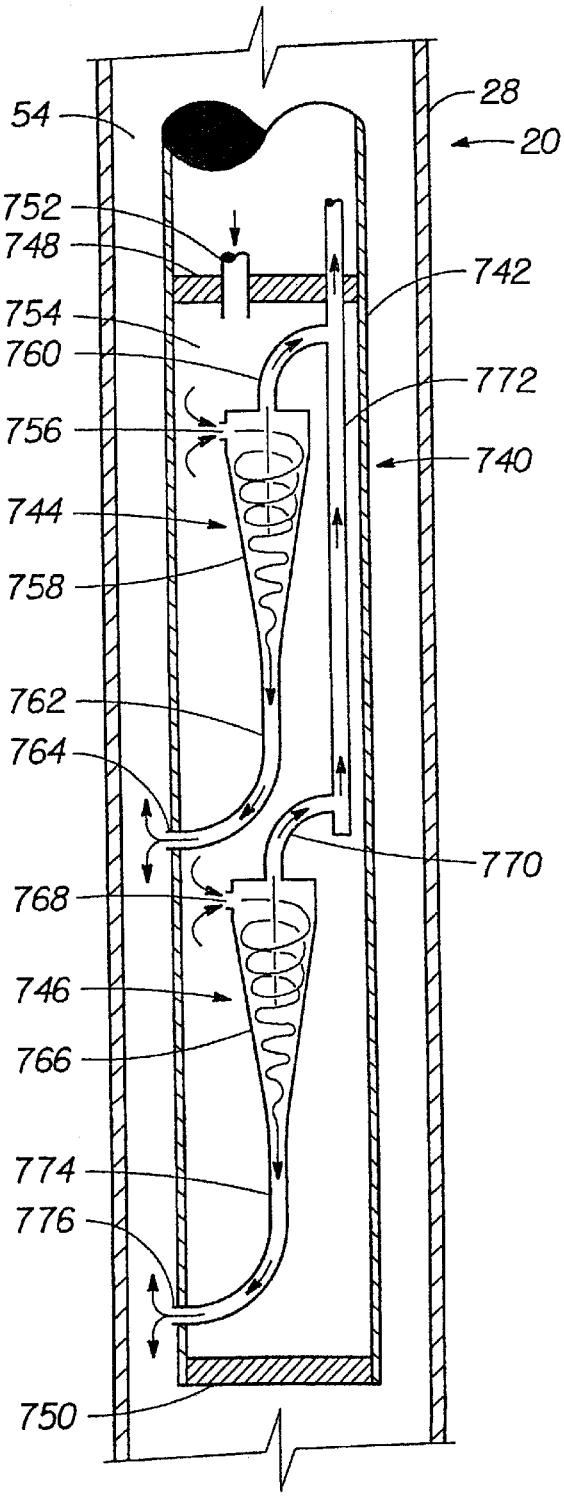
FIG. 23 is a cross-section depicting one exemplary embodiment for a staged multiple hydrocyclone system.

Turning now to FIGS. 23–30, several exemplary hydrocyclone separators are depicted. FIGS. 23–27 depict separator arrangements which maximize the space available for process use. In FIG. 23, an exemplary separator assembly 740 is contained within the wellbore 34 of cased well 20. The separator assembly 740 includes an outer housing 742 which encloses an upper hydrocyclone 744 and lower hydrocyclone 746. The housing 742 is enclosed at its upper end by an upper wall 748 and at its lower end by a lower wall 750. A fluid inlet 752 permits fluid flow through the upper wall 748 into chamber 754 formed by the housing 742 and upper and lower walls 748, 750. The upper hydrocyclone 744 includes at least one lateral fluid inlet 756 and a conically shaped chamber 758. An overflow tube 760 extends outwardly from the upper end of the conical chamber 758. An underflow tube 762 extends from the lower end of the conical chamber 758 and through housing 742 at outlet port 764. The lower hydrocyclone 746 includes a conical chamber 766 and at least one lateral inlet 768. Overflow tube 770 extends from the upper end of the conical chamber 766 and adjoins an overflow header 772 which is disposed through upper wall 748 to affect fluid transfer therethrough. Underflow tubing 774 extends from the lower end of the conical chamber 766 to outlet port 776 in housing 742.

In operation, fluid enters the chamber 754 of the separator assembly 740 through inlet 752. The fluid is typically production fluid which is supplied by a pump. Once within chamber 754, the fluid enters inlets 756 and 768 of the upper hydrocyclone 744 and lower hydrocyclone 746 to enter the conically shaped chambers 758, 766, respectively. By virtue of the hydrocyclones' operation, concentrated oil is separated by the upper hydrocyclone 744 and directed through overflow tube 760 which adjoins overflow header 772 so that the concentrated oil is directed therein. Concentrated oil from the lower hydrocyclone 746 is directed through overflow tube 770 and into overflow header 772. The concentrated oil within the overflow header 772 is then disposed through upper wall 748 to production tubing or a secondary pump so that it may be collected at the surface. Clean water separated by the upper hydrocyclone 744 is directed through underflow tubing 762 and outlet port 764 into wellbore 34. Similarly, clean water separated by the lower hydrocyclone 746 is directed through underflow tubing 774 and outlet 776 into the wellbore 34.

The arrangement described and depicted in FIG. 23 permits space to be saved within wellbore 34 by not requiring the full bore of wellbore 34 to be taken up by the housing 742 of separator assembly 740. This saving of space potentially permits tools to be passed within wellbore 34 or other tubes to be emplaced for the transmission of fluids. The saving of space is made possible by direction of one of the hydrocyclone streams laterally to flood the casing area 34 of the well 20.

Figure 24:
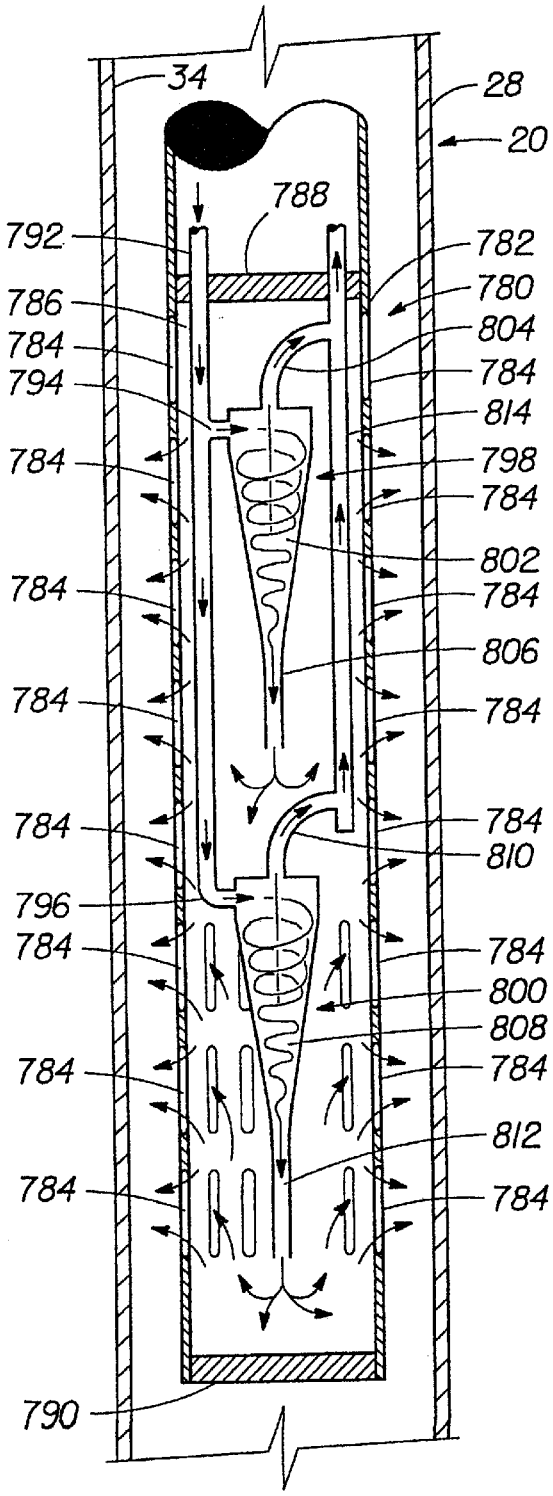
FIG. 24 is a cross-section depicting a second exemplary embodiment for a staged hydrocyclone system.

Referring now to FIG. 24, a similar arrangement is depicted. Separator assembly 780 is disposed within wellbore 34 of well 20. Separator assembly 780 includes a housing 782 having numerous fluid ports 784 disposed therethrough The housing 782 encloses a chamber 786 having an upper wall 788 and lower wall 790. Fluid tubing 792 is disposed through upper wall 788 and includes lateral fluid passages 794, 796 to upper and lower hydrocyclones 798, 800, respectively. The upper hydrocyclone 798 includes an interior conically shaped chamber 802 with overflow tubing 804 and underflow tubing 806 extending therefrom. The lower hydrocyclone 800 also includes a conically shaped chamber 808 with overflow tubing 810 and underflow tubing 812 extending therefrom.

In operation, production fluid is pumped into fluid tubing 792 and enters the upper and lower hydrocyclones 798, 800 through fluid connections 794, 796, respectively. Concentrated oil which is separated by the hydrocyclones 798, 800 exits the hydrocyclones through overflow tubing sections 804, 810, respectively. This concentrated oil is then directed into overflow manifold 814 so that it can enter production tubing or a second pump. Separated clean water exits each of the hydrocyclones 798, 800 through underflow tubing 806, 812, respectively, into housing 782. Once within housing 782, the separated clean water is free to pass into wellbore 34 through ports 784 in the housing 782.

Figure 25:
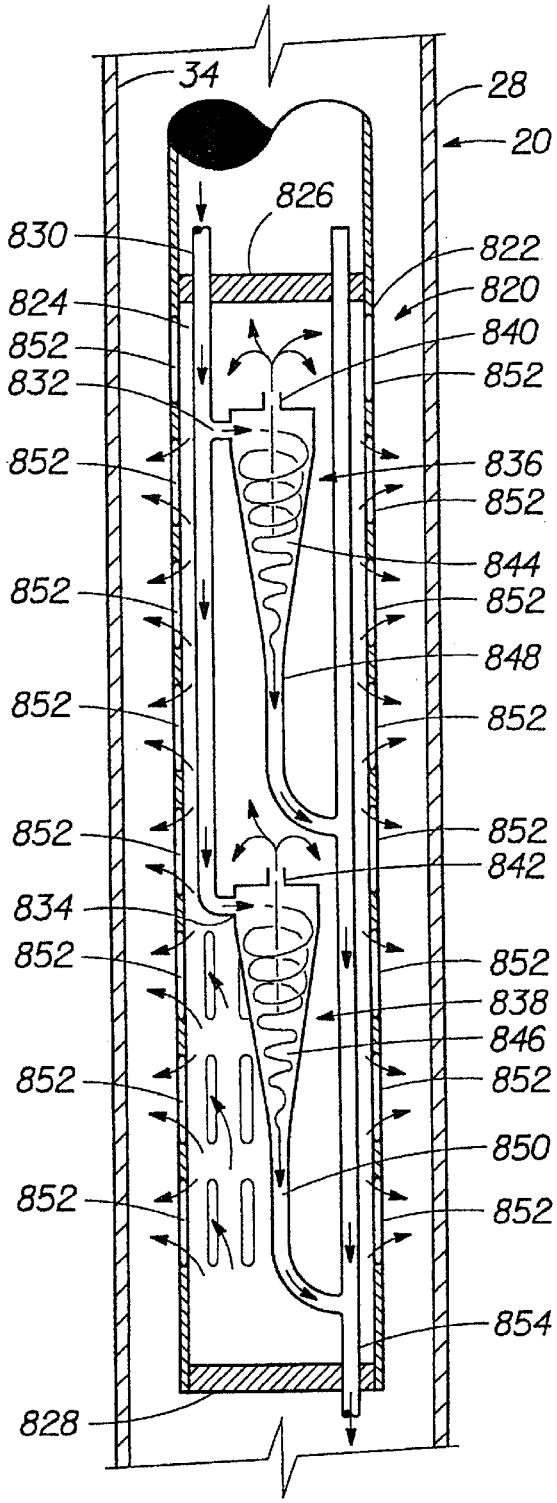
FIG. 25 is a cross-section depicting a third exemplary embodiment for a staged hydrocyclone system.

FIG. 25 shows a variation of the arrangement shown in FIG. 24 in which concentrated oil, rather than separated clean water, exits the separator so as to be disposed into the wellbore 34. Separator assembly 820 is disposed within the wellbore 34 of well 20. The separator assembly 820 features a housing 822 which encloses a chamber 824. The chamber 824 is further enclosed by upper wall 826 and lower wall 828. Fluid tubing 830 is disposed through the upper wall 826 and features fluid connections 832, 834, each of which permits fluid transfer from fluid tubing 830 into upper hydrocyclone 836 and lower hydrocyclone 838, respectively. The upper and lower hydrocyclones 836, 838 include overflow outlets 840, 842, respectively. The hydrocyclones 836, 838 also include conically shaped chamber 844, 846, respectively. Further, the hydrocyclones 836, 838 include underflow tubing 848, 850, respectively. The housing 822 of separator assembly 820 includes a number of fluid ports 852 disposed therethrough. In addition, the housing 822 encloses an underflow manifold 854 which is disposed through lower wall 828.

In operation, production fluid is pumped into separator assembly 820 through tubing 830 where it is disposed through fluid connections 832, 834 into the interior chambers 844, 846 of upper and lower hydrocyclones 836, 838. Clean water which is separated by the hydrocyclones 836, 838 exits the hydrocyclones through underflow tubing 848, 850, respectively, and enters underflow manifold 854 to be disposed through the lower wall 828. From there it may deposited in a disposal zone for entry into injection perforations. Concentrated oil which has been separated by the hydrocyclones 836, 838 exits each hydrocyclone through overflow ports 840, 842, respectively, into the housing 822. Once within the housing 822, the concentrated oil is free to enter the wellbore 34 through fluid ports 852 for direction to the surface of the well 20.

Figure 26:
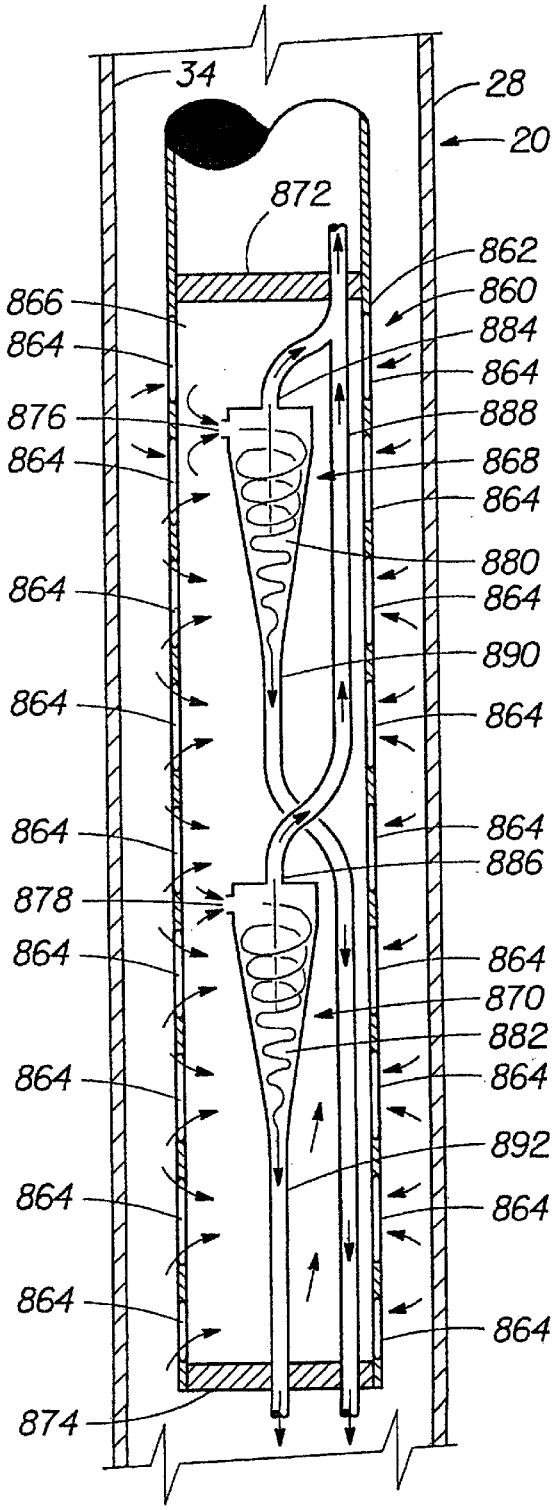
FIG. 26 is a cross-section depicting a fourth exemplary embodiment for a staged hydrocyclone system.

Referring now to FIG. 26, a separator assembly 860 is shown disposed within the wellbore 34 of well 20. The separator assembly 860 includes a casing 862 having numerous fluid ports 864 disposed therethrough. The housing 862 encloses an interior chamber 866 which contains an upper hydrocyclone 868 and a lower hydrocyclone 870. The hydrocyclones 868, 870 are further enclosed by upper and lower walls 872, 874. The hydrocyclones 868, 870 include lateral fluid inlet ports 876, 878 and interior chambers 880, 882, respectively. The hydrocyclones 868, 870 have overflow tubing 884, 886 which leads into an overflow manifold 888 which extends through the upper wall 872. Each of the hydrocyclones 868, 870 also feature underflow tubing 890, 892, each of these extending through the lower wall 874.

Operation of the separator assembly 860 is similar in most respects to that of assembly 820. The production fluid is pumped through wellbore 34 under pressure where it enters fluid ports 864 and chamber 866. The pressure within wellbore 34 causes the production fluid to enter the hydrocyclones 868, 870 and be separated by the hydrocyclones 868, 870. Separated concentrated oil is disposed upwardly through upper wall 872 via overflow manifold 888. Separated clean water is disposed downwardly through lower wall 874 via underflow tubing 892 and 890.

Figure 27:
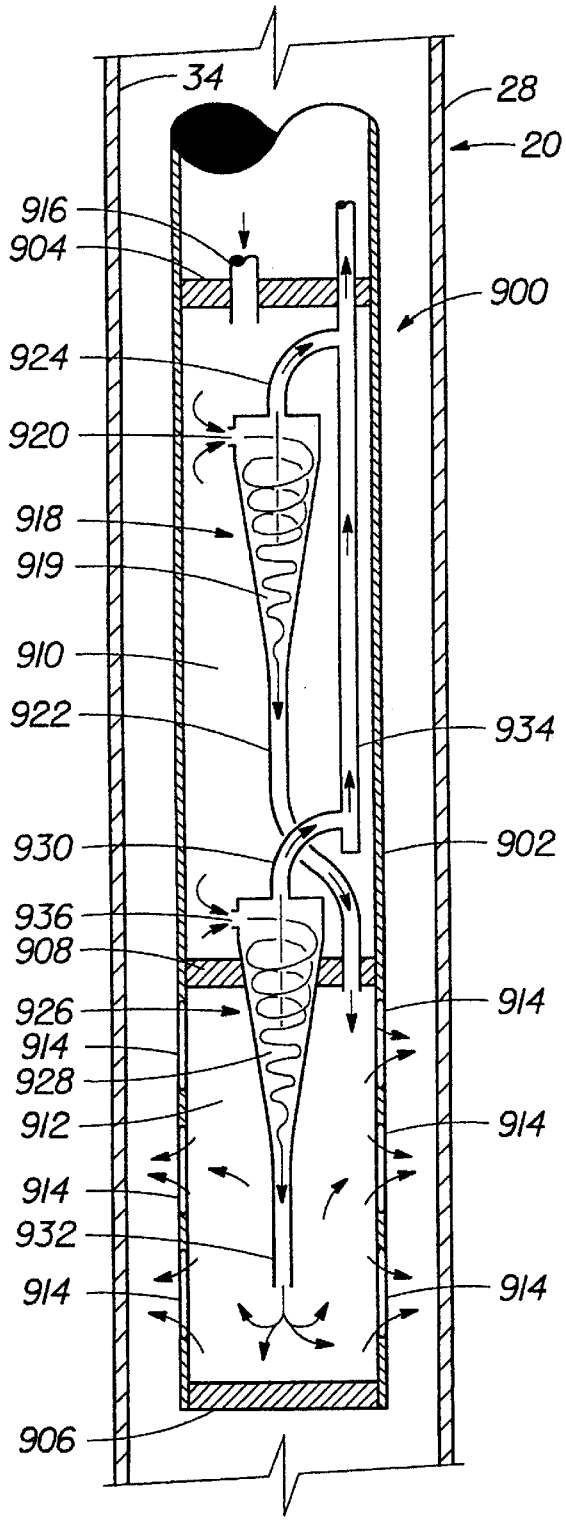
FIG. 27 is a cross-section depicting a fifth exemplary embodiment for a staged hydrocyclone system.

Referring now to FIG. 27, a further exemplary separation assembly 900 is shown disposed within the wellbore 34 of well 20. The separator assembly 900 includes a tubular housing 902 with an upper wall 904, lower wall 906 and an intermediate separation wall 908. Above the intermediate wall 908, an upper chamber 910 is defined by the tubular housing 902, upper wall 904 and intermediate wall 908. The upper chamber 910 is substantially fluid tight. Below intermediate wall 908 a lower chamber 912 is enclosed by a housing 902, intermediate wall 908 and lower wall 906. A number of fluid ports 914 are disposed through housing 902 below intermediate wall 908 such that fluid communication is possible between the annulus formed by wellbore 34 and the lower chamber 912. Fluid tubing 916 is disposed through the upper wall 904 of assembly 900 so that fluid may be transmitted into the upper chamber 910.

An upper hydrocyclone 918 is disposed within the upper chamber 910 and includes a conically-shaped inner chamber 919, lateral fluid inlet 920, underflow tubing 922 and overflow tubing 924. A lower hydrocyclone 926 is located below the upper hydrocyclone 918 and includes a conically shaped chamber 928, overflow tubing 930, and underflow tubing 932. The lower hydrocyclone 926 is disposed through the intermediate wall 908. The overflow tubing 930 which extends from hydrocyclone 926 feeds into an overflow manifold 934 which is disposed through the upper wall 904. Lower hydrocyclone 926 also features at least one lateral fluid inlet 936.

In operation, fluid enters the upper chamber 910 of separator assembly 900 through the fluid inlet 916 under pressure from a pump or some external source. Fluid pressure within the upper chamber 910 then causes the production fluid within to enter the fluid inlets 920, 936 of upper and lower hydrocyclones 918, 926. The production fluid is then separated by each of the hydrocyclones and the separated dry oil is disposed through overflow tubes 924, 930 into overflow manifold 934 where it is transmitted upwardly under pressure through upper wall 904. The separated clean water is disposed through underflow tubes 922, 932 and enters lower chamber 912. Once within lower chamber 912, the separated clean water is free to pass through fluid ports 914 and into the wellbore 34.

Figure 28:
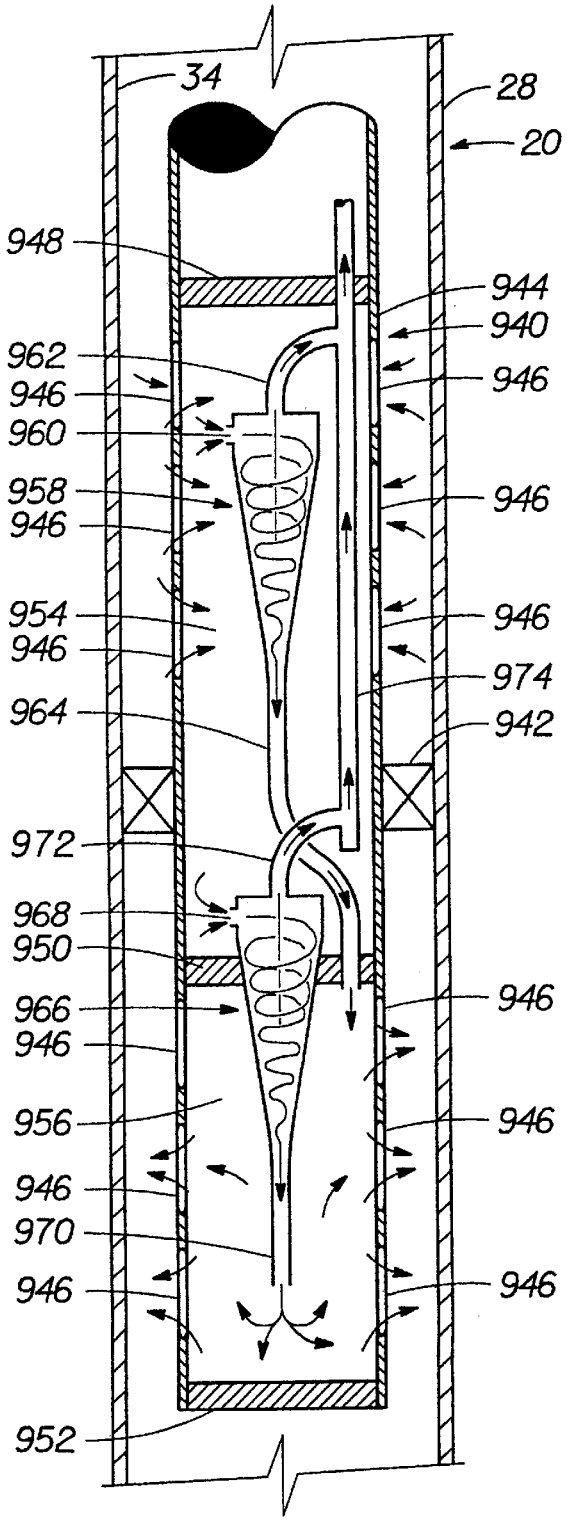
FIG. 28 is a cross-section depicting a sixth exemplary embodiment for a staged hydrocyclone system.

Turning now to FIG. 28, a further exemplary separator assembly 940 is shown disposed within the wellbore 34 of well 20. The separator assembly 940 is packed off using packer 942 which creates a seal between the assembly 940 and the casing 28 of well 20. The separator assembly 940 includes a tubular housing 944 having a number of fluid ports 946 disposed therethrough The assembly 940 also includes an upper wall 948, intermediate wall 950 and lower wall 952. An upper chamber 954 is enclosed by the tubular housing 944, the upper wall 948 and the intermediate wall 950. A lower chamber 956 is enclosed by tubular housing 944, intermediate wall 950 and lower wall 952. An upper hydrocyclone 958 is disposed within the upper chamber 954 and includes a lateral fluid inlet 960, overflow tubing 962 and underflow tubing 964 which extends through the intermediate wall 950. A lower hydrocyclone 966 is disposed through the intermediate wall 950 in the manner depicted. The lower hydrocyclone 966 includes a lateral fluid inlet 968 which is located above the intermediate wall 950 within upper chamber 954. Underflow tubing 970 extends from the lower end of the lower hydrocyclone 966 to empty into the lower chamber 956. Overflow tubing 972 extends from the upper end of lower hydrocyclone 966 into overflow manifold 974. The underflow tubing 962 of the upper hydrocyclone 958 also adjoins the overflow manifold 974. Overflow manifold 974 extends through the upper wall 948 above.

In operation, pressurized production fluid within wellbore 34 above the packer 942 will enter the fluid ports 946 of housing 944 to enter the upper chamber 954. In the upper chamber 954, the pressurized production fluid enters fluid inlet 960, 968 of the upper and lower hydrocyclones 958, 966, respectively. The hydrocyclones 958, 966 separate the production fluid, as described previously, into concentrated oil and clean water. The concentrated oil is disposed through overflow tubing 962, 972 and enters overflow header 974 where it is disposed through the upper wall 948 thereby leaving the separator 940. Separated clean water is disposed through underflow tubing 964, 970 for release into the lower chamber 956. Once within lower chamber 956, the clean water is free to be disposed through the fluid ports 946 of housing 944 for exit into the wellbore 34.

Figure 29:
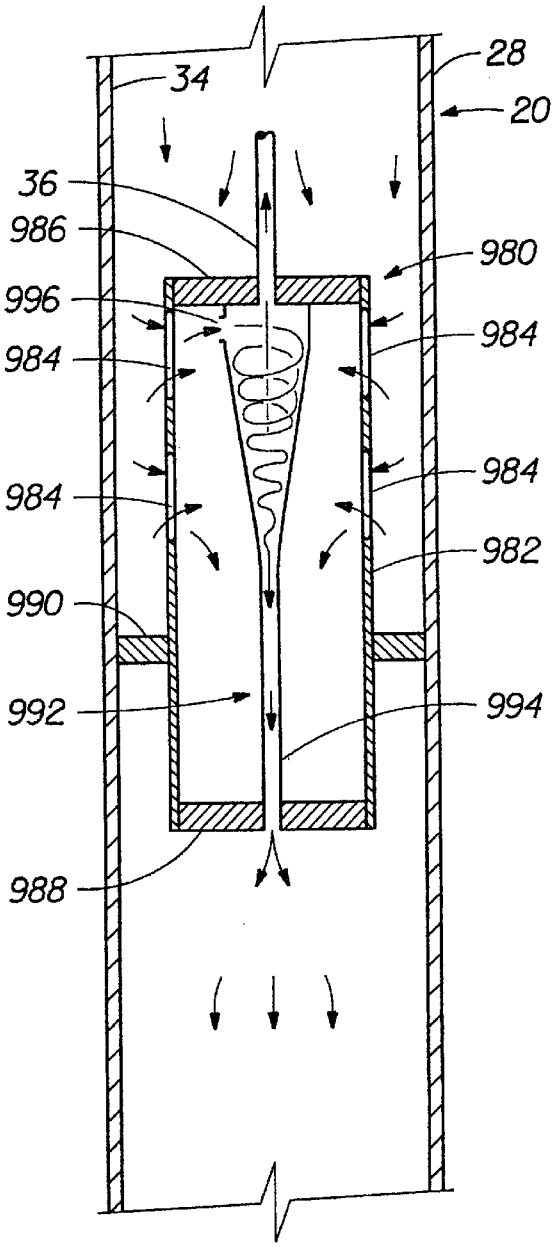
FIGS. 29 and 30 are each cross-sections depicting exemplary single hydrocyclone separator systems.

Turning now to FIG. 29, a separator system is depicted in which a single hydrocyclone is used. A string of production tubing 36 extends downwardly within the wellbore 34 of well 20. Affixed to the lower end of production tubing 36 is a separator assembly 980 which includes an outer tubular housing 982 having fluid ports 984 disposed therethrough. The housing 982 is enclosed at its upper end by an upper wall 986 through which production tubing 36 is disposed and at its lower end by a lower wall 988. The housing 982 is set against the casing 28 of well 20 by a seal or packer 990. A hydrocyclone 992 is affixed within the housing 982 such that the underflow tubing 994 extends through the lower wall 988 of housing 982. The upper end of the hydrocyclone 992 is affixed to the upper wall 986 such that separated overflow will enter the production tubing 36. The hydrocyclone 992 also includes a lateral fluid inlet 996 proximate its upper end.

In operation, pressurized production fluid within wellbore 34 above the seal 990 will enter the ports 984 of the housing 982 and then the lateral fluid inlets 996 of the hydrocyclone 992. The hydrocyclone 992 will separate the production fluid as described previously and direct separated dry oil into production tubing 36 while separated clean water is disposed through underflow tubing 994.

Figure 30:
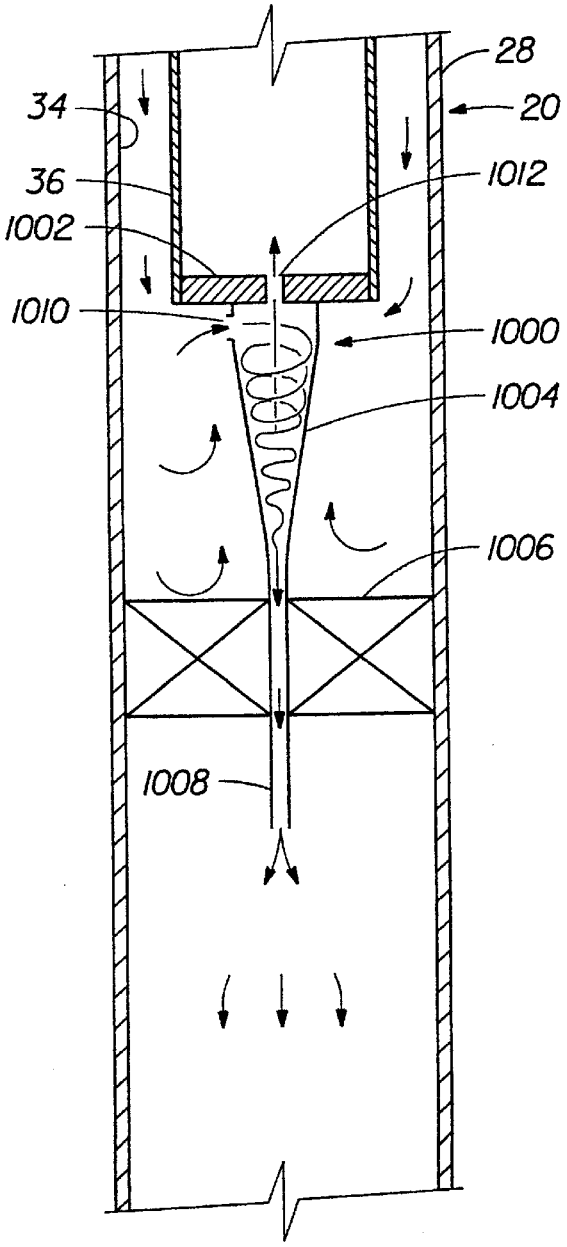

Turning now to FIG. 30, a further hydrocyclone assembly arrangement 1000 is shown. Production tubing 36 extending from the surface of well 20 within wellbore 32 is enclosed at its lower end by lower wall 1002. Beneath the lower wall 1002 is affixed a hydrocyclone 1004 which is packed off with packer 1006 to form a seal between the hydrocyclone 1004 and casing 28 of well 20. The hydrocyclone 1004 includes underflow tubing 1008 which exits below the packer 1006. Hydrocyclone 1004 also includes lateral fluid inlets 1010 located above the packer 1006 and overflow port 1012 which extends through the lower wall 1002 of production tubing 36.

In operation, pressurized production fluid present within wellbore 34 above packer 1006 enters the lateral fluid inlet 1010 of hydrocyclone 1004. Clean water is separated by the hydrocyclone 1004 exits through underflow tubing 1008 to portions of the wellbore below packer 1006. Separated concentrated oil is directed through overflow port 1012 into production tubing 36 for delivery to the surface of well 20.

Figure 31:
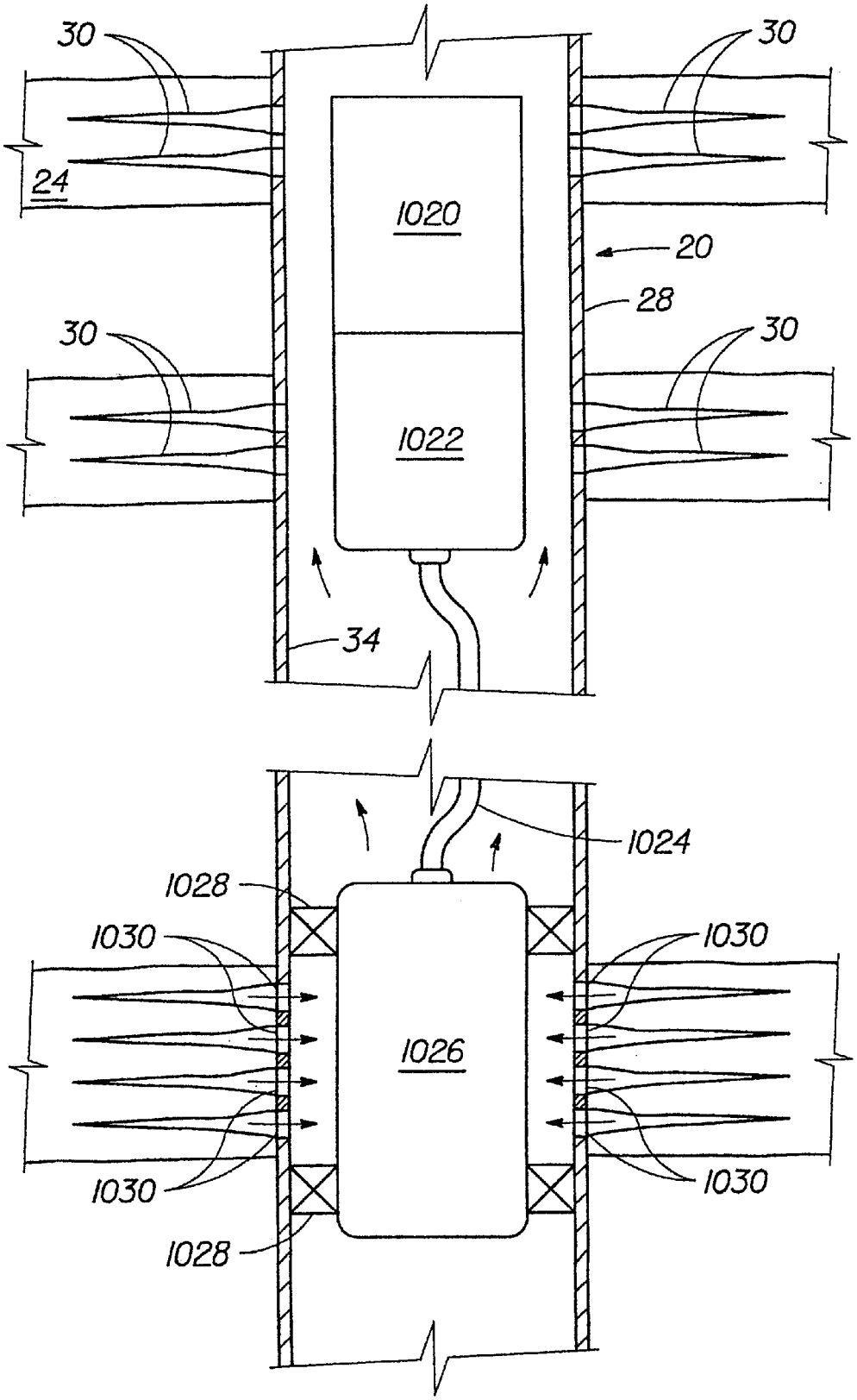
FIG. 31 is a cross-section depicting an alternative power supply arrangement using a downhole source.

Turning now to FIG. 31, a further arrangement is depicted whereby the power supply cable, which typically supplies power to a downhole motor from the surface, is eliminated. Portions of an exemplary separation assembly, namely from the separator downward, are depicted in FIG. 31. A separator assembly 1020 is shown suspended within wellbore 34. The components located above separator 1020 are not important to this aspect of the invention and therefore are not shown here. The separator 1020 is affixed at its lower end to a pump/motor assembly 1022. A power transmission cable

1024 extends between the lower end of the pump/motor assembly 1022 and a power source 1026 located within the wellbore 34 below. The power source 1026 is secured within the wellbore 34 by one or more packers 1028 which establish a seal between the power source 1026 and the casing 28 of well 20. The power source 1026 preferably comprises a battery or fuel cell to provide a self-contained fuel supply within the wellbore 34. Alternatively, power source 1026 may comprise a gas or liquid driven generator which would operate in response to gases entering the wellbore 34 from exemplary perforations 1030. Preferably, the area of the wellbore 34 which includes the perforations 1030 is contained at its upper and lower ends by packers such as packers 1028 shown in FIG. 31.

Although the invention has been described in terms of preferred embodiments, those skilled in the art will recognize that numerous modifications and changes may be made while remaining within the scope and spirit of the invention.

What is claimed is:

1. A system for producing a hydrocarbon-rich stream from a well and for disposing a water-rich stream into a disposal zone, comprising:

a) tubing extending in a wellbore, the wellbore penetrating at least partially a hydrocarbon production zone and the disposal zone;

b) a packer disposed in the wellbore;

c) an assembly coupled to the tubing, comprising:

i) a fluid operated motor having an intake and an exhaust;

ii) a pump coupled to the motor;

iii) a separator having a hydrocarbon-rich stream outlet in fluid communication with the tubing and a water-rich stream outlet in fluid communication with the disposal zone, the motor exhaust being in fluid communication with at least one of the streams of the separator.

2. The system of claim 1, wherein the motor exhaust is in fluid communication with the hydrocarbon-rich stream.

3. The system of claim 1, further comprising a check valve in fluid communication with the water-rich stream outlet for blocking a return fluid flow of fluid from the disposal zone and a selectively actuated release mechanism disposed between the separator and the check valve to enable retrieval of the separator while the check valve remains downhole.

4. The system of claim 1, further comprising a rotary gas separator having a gas outlet and a fluid outlet, the gas separator being in fluid communication with the pump.

5. The system of claim 4, wherein the rotary gas separator comprises a liquid outlet in fluid communication with an inlet to the separator.

6. The system of claim 1, further comprising an eductor in fluid communication with the hydrocarbon-rich stream from the separator.

7. The system of claim 6, wherein the rotary gas separator comprises a gas outlet in fluid communication with the eductor.

8. The system of claim 6, wherein the motor exhaust is in fluid communication with the eductor.

9. The system of claim 1, wherein the water-rich stream outlet of the separator is in fluid communication with an inlet of the pump.

10. The system of claim 9, wherein an outlet of the pump in is fluid communication with the disposal zone.

11. The system of claim 1, further comprising gas lift valves coupled to the tubing.

12. The system of claim 1, wherein the disposal zone is disposed above the hydrocarbon production zone and the packer is disposed above the disposal zone and further comprising a second packer disposed below the disposal zone, the pump being disposed below the second packer.

13. The system of claim 12, further comprising a second tube in fluid communication with the motor intake and disposed through at least one of the packers.

14. The system of claim 13, further comprising a gas lift tube extending between the second tube and the tubing extending in the wellbore.

15. A system for producing a hydrocarbon-rich stream from a well and for disposing a water-rich stream into a formation, comprising:

a) tubing extending in a wellbore, the wellbore penetrating at least partially a hydrocarbon production zone and a disposal zone;

b) a packer disposed in the wellbore;

c) an assembly coupled to the tubing, comprising:

i) a fluid operated motor having an intake and an exhaust, the exhaust comprising ports on the motor, the ports being in fluid communication with the wellbore;

ii) a pump coupled to the motor;

iii) a separator having a hydrocarbon-rich stream outlet in fluid communication with the tubing and a water-rich stream outlet in fluid communication with the disposal zone.

16. The system of claim 15, further comprising gas lift valves coupled to the tubing.

17. The system of claim 1, wherein the motor exhaust is in fluid communication with the water-rich stream.

18. The system of claim 17, further comprising a motor exhaust tube extending substantially concentrically through the tubing, the motor exhaust tube extending to the disposal zone and the tubing sealably disposed from the disposal zone and in fluid communication with the hydrocarbon-rich stream outlet.

19. An assembly for producing a hydrocarbon-rich stream from a well in cooperation with tubing extending in a wellbore and for disposing a water-rich stream into a disposal zone, the wellbore penetrating at least partially a hydrocarbon producing zone and the disposal zone, comprising:

a) a fluid operated motor having an intake and an exhaust;

b) a pump coupled to the motor;

c) a separator having an inlet in fluid communication with the pump and a hydrocarbon-rich stream outlet in fluid communication with the tubing and a water-rich stream outlet in fluid communication with the disposal zone, the motor exhaust being in fluid communication with at least one of the outlets of the separator.

20. The assembly of claim 19, wherein the motor exhaust is fluid communication with the hydrocarbon-rich stream.

21. A method of producing a hydrocarbon-rich stream from a well and for disposing a water-rich stream into a disposal zone, comprising:

a) powering a motor coupled to a pump with a fluid;

b) separating production fluid into a hydrocarbon-rich stream and a water-rich stream;

c) disposing the water-rich stream into a disposal zone; and d) injecting exhaust fluid from the motor into at least one of the streams.

22. The method of claim 21, wherein the exhaust fluid is injected into the hydrocarbon-rich stream.

23. The method of claim 21, further comprising separating gas from the production fluid through a gas separator.

24. The method of claim 23, wherein separating gas from the production fluid occurs prior to separating the production fluid into a hydrocarbon-rich stream and a water-rich stream.

25. The method of claim 24, further comprising reinjecting the separated gas into the hydrocarbon-rich stream after the water-rich stream is separated therefrom.

* * * * *